US007503671B2

(12) United States Patent
Kang et al.

(10) Patent No.: US 7,503,671 B2
(45) **Date of Patent: *Mar. 17, 2009**

(54) FLASHLIGHT

(75) Inventors: Sukwon Greg Kang, Torrance, CA (US); Kiem T. Lee, Whittier, CA (US); Shahid Ali, Rowland Heights, CA (US)

(73) Assignee: Pelican Products, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/767,431

(22) Filed: Jun. 22, 2007

(65) Prior Publication Data

US 2008/0013308 A1 Jan. 17, 2008

Related U.S. Application Data

(63) Continuation-in-part of application No. 11/767,397, filed on Jun. 22, 2007, now Pat. No. 7,441,920.

(60) Provisional application No. 60/807,324, filed on Jul. 13, 2006.

(51) Int. Cl.
*F21L 4/04* (2006.01)

(52) U.S. Cl. ..... 362/205; 362/206; 362/295

(58) Field of Classification Search ..... 362/205–206, 362/295

See application file for complete search history.

(56) References Cited

U.S. PATENT DOCUMENTS

| | | | |
|---|---|---|---|
| 1,538,992 | A | 5/1925 | Hopkins |
| 2,530,913 | A | 11/1950 | Shackel |
| 4,001,803 | A | 1/1977 | Lombardo |
| 4,074,122 | A | 2/1978 | Moore |
| 4,149,224 | A | 4/1979 | King et al. |
| 4,274,130 | A | 6/1981 | Elliott |
| 4,782,432 | A | 11/1988 | Coffman |
| 4,823,242 | A | 4/1989 | Maglica et al. |
| 4,841,417 | A | 6/1989 | Maglica et al. |
| 4,864,474 | A | 9/1989 | Maglica |
| 4,962,347 | A | 10/1990 | Burroughs et al. |

(Continued)

FOREIGN PATENT DOCUMENTS

| | | | |
|---|---|---|---|
| DE | 200 06 963 | U1 | 8/2000 |

(Continued)

OTHER PUBLICATIONS

International Search Report from PCT/US2007/073464.

(Continued)

*Primary Examiner*—Sandra L O'Shea
*Assistant Examiner*—Jason Moon Han
(74) *Attorney, Agent, or Firm*—Greenberg Traurig, LLP

(57) ABSTRACT

A flashlight includes a battery and a circuit for operation to signal to a user that the battery voltage is at selected voltage or power level. There can be two switches each being for operating a light emitting source of the flashlight. The switches are linked 3-way switches and have momentary-on functionality. An enlarged head is located above the barrel and there is the intermediate portion between the head and the barrel. The intermediate portion receives part of the first switch. The second switch is located in part of the tail cap of the flashlight.

35 Claims, 15 Drawing Sheets

U.S. PATENT DOCUMENTS

| | | | | |
|---|---|---|---|---|
| 5,121,308 | A | 6/1992 | Maglica et al. | |
| 5,124,892 | A | 6/1992 | Lambert | |
| 5,138,538 | A | 8/1992 | Sperling | |
| 5,268,826 | A | 12/1993 | Greene | |
| 5,412,548 | A | 5/1995 | Yee | |
| 5,432,689 | A | 7/1995 | Sharrah et al. | |
| 5,541,822 | A | 7/1996 | Bamber | |
| 5,629,105 | A | 5/1997 | Matthews | |
| 5,749,646 | A | 5/1998 | Brittell | |
| 5,806,961 | A * | 9/1998 | Dalton et al. | 362/183 |
| 5,839,821 | A | 11/1998 | LeZotte | |
| 6,000,811 | A | 12/1999 | Bordak | |
| 6,004,004 | A | 12/1999 | Altman et al. | |
| 6,017,129 | A | 1/2000 | Krietzman | |
| 6,045,237 | A | 4/2000 | Parsons et al. | |
| 6,095,661 | A | 8/2000 | Lebens et al. | |
| 6,184,794 | B1 | 2/2001 | Tucholski | |
| 6,186,641 | B1 | 2/2001 | Parker | |
| RE37,092 | E | 3/2001 | Sharrah et al. | |
| 6,222,138 | B1 | 4/2001 | Matthews et al. | |
| 6,283,609 | B1 | 9/2001 | Parsons et al. | |
| 6,296,367 | B1 | 10/2001 | Parsons et al. | |
| 6,296,371 | B1 | 10/2001 | Shiau | |
| 6,305,818 | B1 | 10/2001 | Lebens et al. | |
| 6,386,730 | B1 | 5/2002 | Matthews | |
| 6,435,689 | B2 | 8/2002 | Pitts | |
| 6,474,833 | B1 | 11/2002 | Parsons et al. | |
| 6,488,388 | B2 | 12/2002 | Jones | |
| 6,488,390 | B1 | 12/2002 | Lebens et al. | |
| 6,533,436 | B2 | 3/2003 | Krietzman et al. | |
| 6,534,926 | B1 | 3/2003 | Miller et al. | |
| 6,616,296 | B1 * | 9/2003 | Roux et al. | 362/184 |
| 6,623,140 | B2 | 9/2003 | Watterson et al. | |
| 6,641,279 | B1 | 11/2003 | Williams | |
| 6,702,452 | B2 | 3/2004 | Jigamian et al. | |
| 6,805,461 | B2 | 10/2004 | Witte | |
| 6,808,287 | B2 | 10/2004 | Lebens et al. | |
| 6,814,465 | B2 | 11/2004 | Forsythe | |
| 6,814,466 | B2 | 11/2004 | Parsons et al. | |
| 6,880,951 | B2 * | 4/2005 | Yoon | 362/206 |
| 6,893,143 | B2 | 5/2005 | Opolka | |
| 6,896,392 | B2 | 5/2005 | Jigamian et al. | |
| 6,909,250 | B2 | 6/2005 | Jigamian et al. | |
| 6,942,365 | B2 | 9/2005 | Galli | |
| 6,966,677 | B2 | 11/2005 | Galli | |
| 6,979,104 | B2 | 12/2005 | Brass et al. | |
| 7,033,042 | B2 | 4/2006 | Lim | |
| 7,059,742 | B2 | 6/2006 | Chen | |
| 7,293,893 | B2 * | 11/2007 | Kim | 362/205 |
| 7,334,915 | B2 | 2/2008 | Kim | |
| 7,393,120 | B2 | 7/2008 | Kang et al. | |
| 7,441,920 | B2 | 10/2008 | Kang et al. | |
| 2003/0095408 | A1 | 5/2003 | Opolka | |
| 2003/0107885 | A1 | 6/2003 | Galli | |
| 2003/0123253 | A1 | 7/2003 | Krietzman et al. | |
| 2003/0223227 | A1 | 12/2003 | Levine | |
| 2004/0050188 | A1 | 3/2004 | Richards et al. | |
| 2004/0190288 | A1 | 9/2004 | Hsu | |
| 2005/0002186 | A1 | 1/2005 | Krieger et al. | |
| 2005/0007777 | A1 | 1/2005 | Klipstein et al. | |
| 2005/0024864 | A1 | 2/2005 | Galli | |
| 2005/0063179 | A1 | 3/2005 | Niemann | |
| 2005/0122712 | A1 | 6/2005 | Kim | |
| 2005/0122714 | A1 | 6/2005 | Matthews et al. | |
| 2005/0237734 | A1 * | 10/2005 | Krieger | 362/157 |
| 2006/0109655 | A1 | 5/2006 | Martin | |
| 2006/0164828 | A1 | 7/2006 | Kim | |
| 2007/0109774 | A1 | 5/2007 | Booty | |
| 2007/0145912 | A1 | 6/2007 | Spartano et al. | |
| 2007/0183152 | A1 | 8/2007 | Hauck et al. | |
| 2007/0246335 | A1 | 10/2007 | Sharrah et al. | |

FOREIGN PATENT DOCUMENTS

| | | |
|---|---|---|
| DE | 101 61 017 A1 | 6/2003 |
| DE | 203 13 781 U1 | 2/2004 |
| EP | 0 207 691 | 1/1987 |
| EP | 1 848 016 | 10/2007 |
| JP | 06267307 | 9/1994 |
| JP | 08007602 | 1/1996 |
| WO | WO 2005/047763 | 5/2005 |
| WO | WO 2005/060715 | 7/2005 |

OTHER PUBLICATIONS

Military Office Resupply Express, "3 way Flashlight w/ Magnet", source(s): http://www.usastationery.com/catalog/product_info.php?cPath=1500267_1500295&products_id=2510025&osCsid=10.

Los Angeles Police Department Issued Flashlight Specifications, Mar. 2, 2006 (3 pages).

House Wiring, 8th Ed., pp. 162-165 and 174-175 (2004) (7 pages).

http://www.pelican.com/lights_detail.php?recordID=1830, (2006) (1 page).

http://www.pelican.com/lights_detail.php?recordID=1930, (2001) (2 pages).

http://www.pelican.com/lights_detail.php?recordID=2320, (2003) (2 pages).

http://www.pelican.com/lights_detail.php?recordID=2330, (2004) (2 pages).

http://www.pelican.com/lights_detail.php?recordID=2340, (2000) (2 pages).

http://www.pelican.com/lights_detail.php?recordID=2430, (2005) (1 pages).

http://www.pelican.com/lights_detail.php?recordID=7050, (1990) (2 pages).

http://www.pelican.com/lights_detail.php?recordID=7060, (2007) (2 pages).

http://www.pelican.com/lights_detail.php?recordID=8040, (2000) (2 pages).

http://www.pelican.com/lights_detail.php?recordID=8050, (1999) (2 pages).

* cited by examiner

FIG. 25
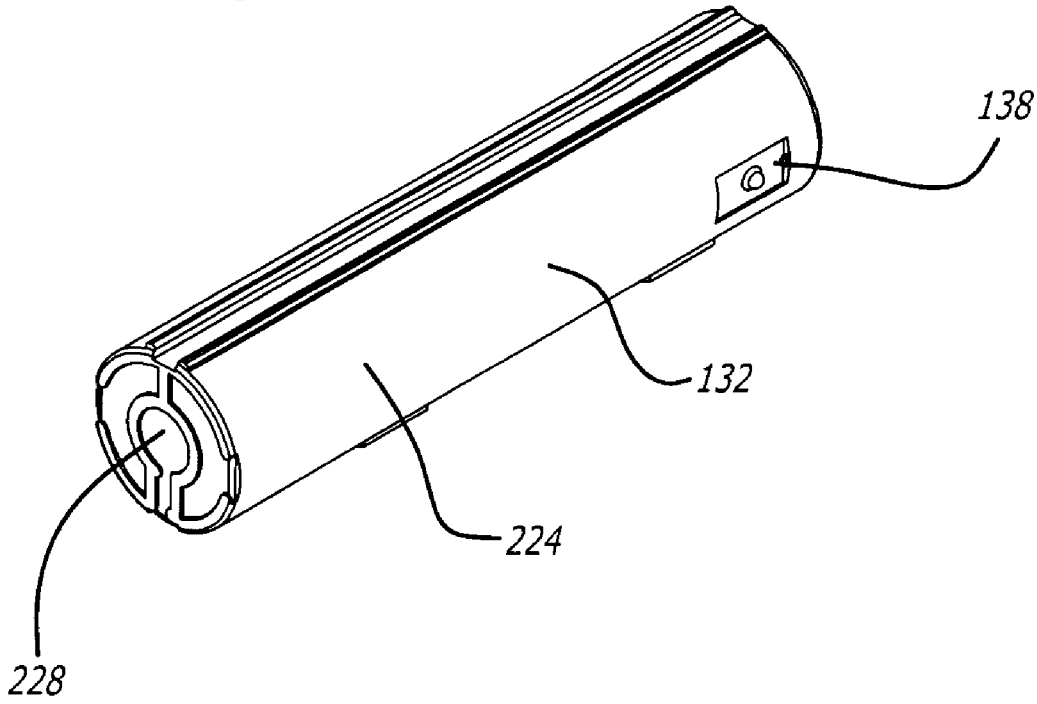
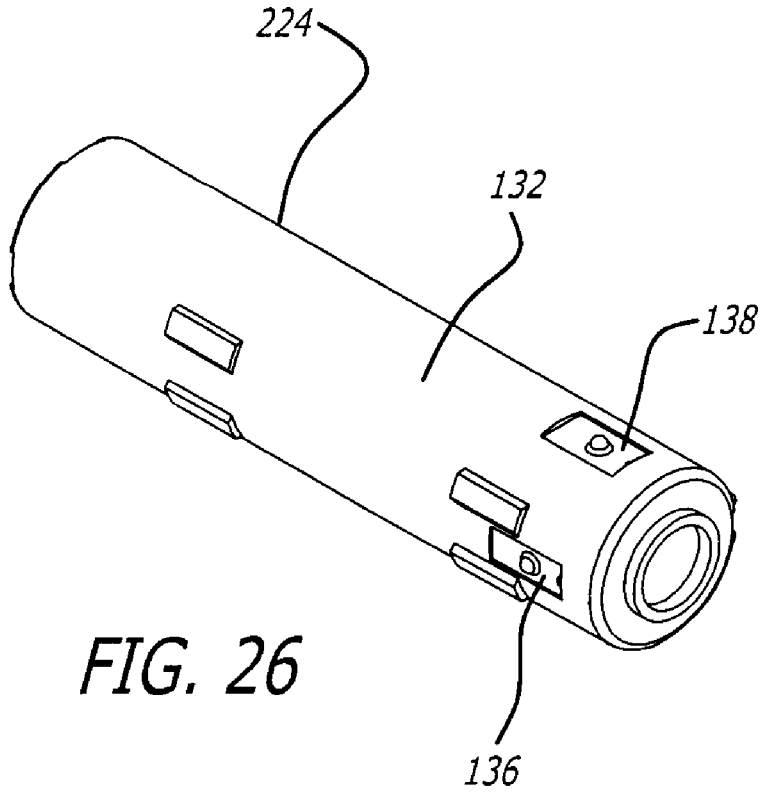
FIG. 26

FLASHLIGHT

RELATED APPLICATIONS

This application is a Continuation-In-Part of U.S. Utility patent application Ser. No. 11/767,397, filed Jun. 22, 2007, which claims the benefit of and priority to U.S. Provisional Application Ser. No. 60/807,324, filed Jul. 13, 2006. The contents of both applications are incorporated by reference herein in their entirety.

BACKGROUND

1. Field

This disclosure relates to a flashlight.

2. General Background

Many flashlight configurations are known. Additionally, different flashlight configurations are known which are non-rechargeable and also rechargeable.

The various known flashlights are often not as simple and inexpensive to manufacture as desirable, while at the same time having effective characteristics of longevity and ability to work in different conditions.

Contemporary flashlights with non power regulated electrical circuits grow dimmer as the battery voltage depletes. Lithium ion batteries tend to maintain their voltage, especially when combined with a regulated power circuit, up to a point where they rapidly decline in voltage and cease to function with very little warning. This can be a problem is usage and in the field.

The disclosure is directed to providing a flashlight which minimizes the disadvantages of known flashlights.

SUMMARY

By the present disclosure, there is provided a flashlight which minimizes the disadvantages of known flashlights.

The flashlight includes a feature designed to alert the user that the battery voltage is at selected voltage or power levels. This can be, selectively at a low, and preferably a very low level.

The flashlight emits a signal, preferably by flashing on and off repeatedly for a selected time period, before the light emitting source is extinguished. This time period can selectively be about 2 minutes.

The flashlight can be operated ideally with one or more fingers or the thumb of a human hand for switching of that flashlight with a first switch. The flashlight also operates by switching a second switch ideally with a thumb or palm area of the hand.

The flashlight includes a battery barrel having a front end and a tail-end opposite that front end. The flashlight has an elongated battery barrel provided with a tail-end switch, which is the second switch. At the front end of the elongated battery barrel there is a lamp assembly including a lamp and lamp reflector pointing longitudinally away from the elongated battery barrel. The battery barrel at its tail-end includes a tail-end switch for the flashlight. The tail-end switch for the flashlight on the battery barrel or closure cap for the barrel at the tail-end is electrically connectible to the lamp, through the first switch and also through the battery pack in the barrel.

The battery flashlight is provided with a body portion being the barrel, an intermediate section and a head. Ahead of the intermediate section is located an enlarged head which includes a lens and the lamp which is an LED bulb.

The flashlight is loaded with a battery or battery pack. There are contacts on the body for possible recharging of the internal battery. These are on an intermediate portion above the barrel opposite to the first switch device in the intermediate portion.

A helical spring is located at the top of the battery and another helical spring is located at the bottom of the battery. The springs retain the battery in a shock-absorbing mode. The helical spring at the bottom is located between the tail switch at the base of the barrel and the battery, and may be in electrical contact with the battery. The helical spring at the top is located between the battery and a switching device, which is transversely mounted in an intermediate section above the barrel of the flashlight. The top helical spring may also be in electrical contact.

The disclosure is further described with reference to the accompanying drawings.

BRIEF DESCRIPTION OF THE DRAWINGS

The above-mentioned features and objects of the present disclosure will become more apparent with reference to the following description taken in conjunction with the accompanying drawings, wherein like reference numerals denote like elements and in which:

FIG. 25 is a respective view of the battery pack viewed from the rear.

FIG. 26 is a respective view of the battery pack viewed from the front.

FIG. 28 is a side schematic view of the flashlight showing the 3-way switches in an electrical circuit and the flashlight on.

DETAILED DESCRIPTION

Figures 1, 2, 3, 4, 5:
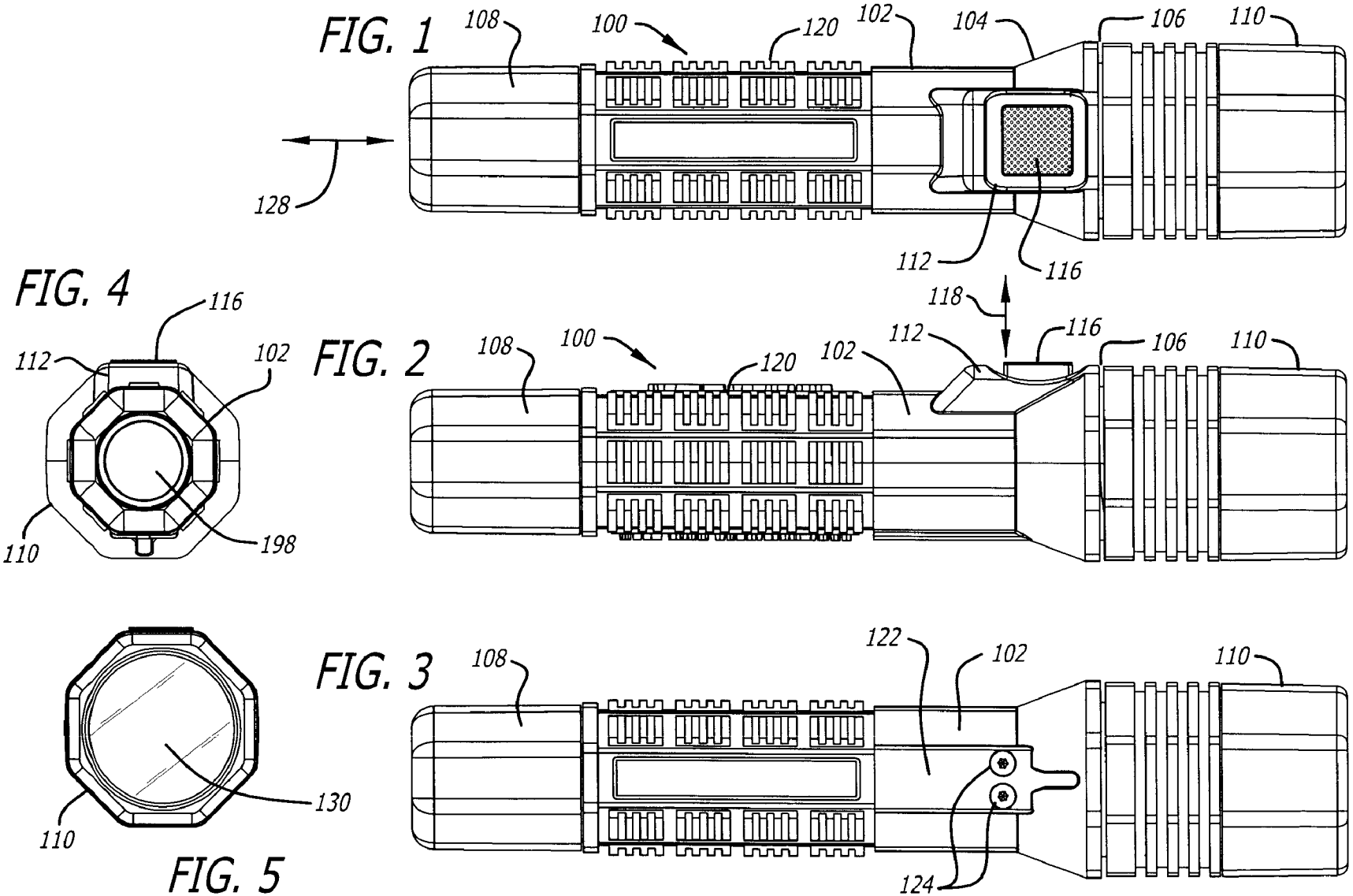
FIG. 1 is a side view of the flashlight showing the top of the flashlight with the first switch, namely the transversely directed switch in the intermediate section of the flashlight.
FIG. 2 is a side view of the flashlight from a 90 degree turned view relative to FIG. 1.
FIG. 3 is a side view of the flashlight showing the under view of the flashlight including terminals or connections for connection with a recharger unit.
FIG. 4 is a bottom view of the flashlight showing the second switch in the tail of the barrel.
FIG. 5 is a front view of the flashlight showing the top of the head of the flashlight and the section holding the lens.
Figure 6:
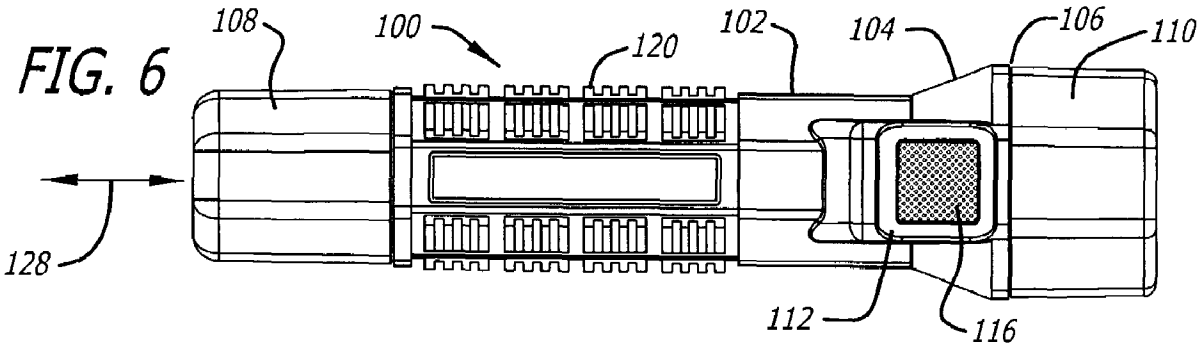
FIGS. 6 through 10 are respectively similar to FIGS. 1 through 5 of the flashlight. The LED housing portion of the flashlight in FIG. 6 through 10 are relatively smaller and shorter than the head section of the flashlight in FIGS. 1 through 5. Also the barrel section in FIGS. 6 through 10 are relatively smaller and shorter than the flashlight in FIGS. 1 through 5. Overall the model of the flashlight in FIGS. 6 through 10 is relatively smaller flashlight than the flashlight in FIGS. 1 through 5.
Figure 7:
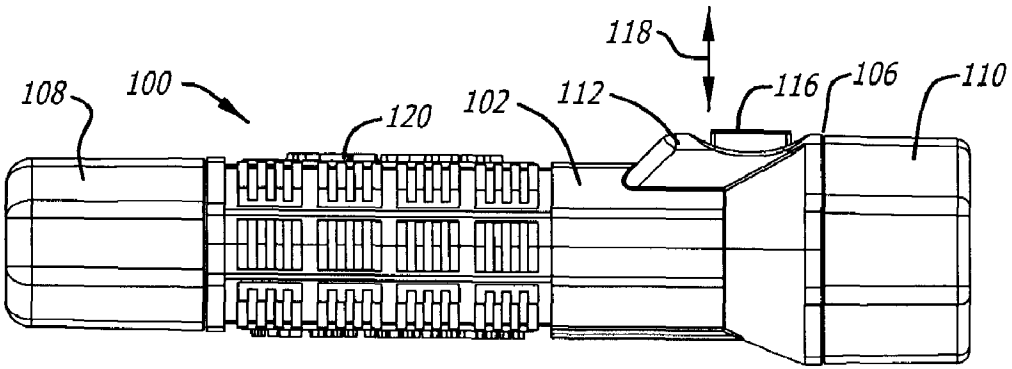
Figure 8:
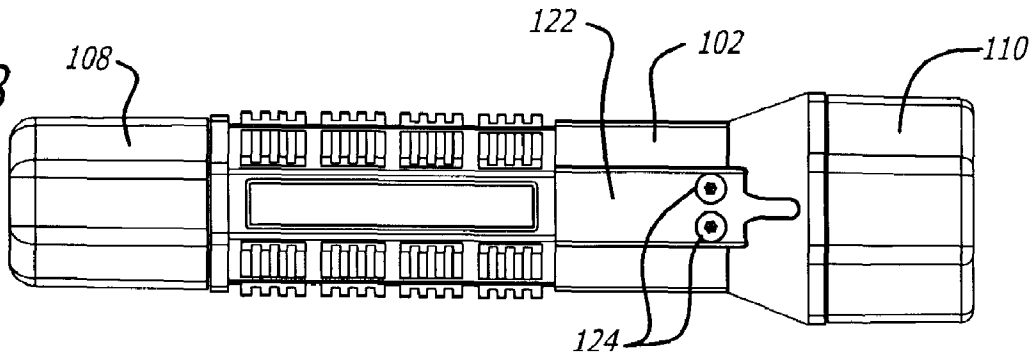
Figure 9:
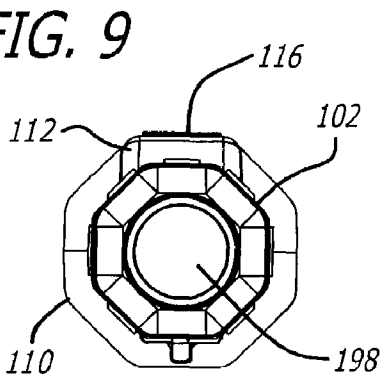
Figure 10:
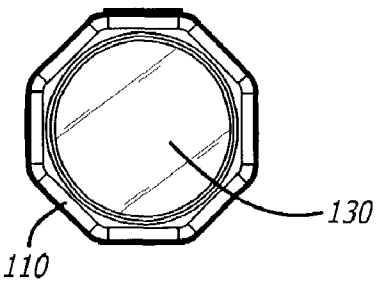
Figure 12:
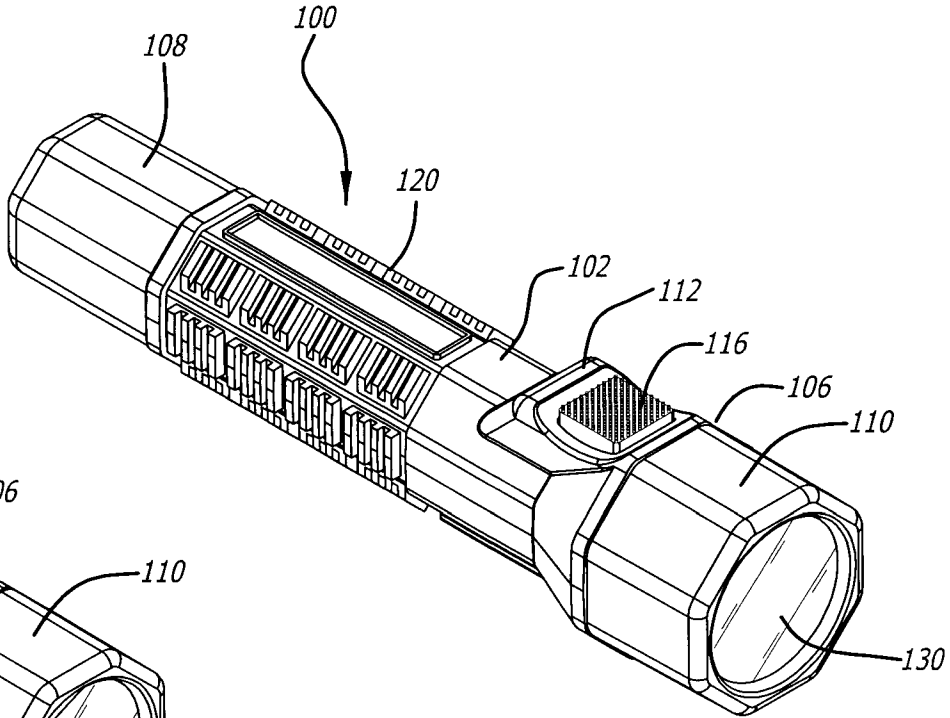
FIG. 12 is an oblique view of the flashlight in FIGS. 6 through 10.
Figure 11:
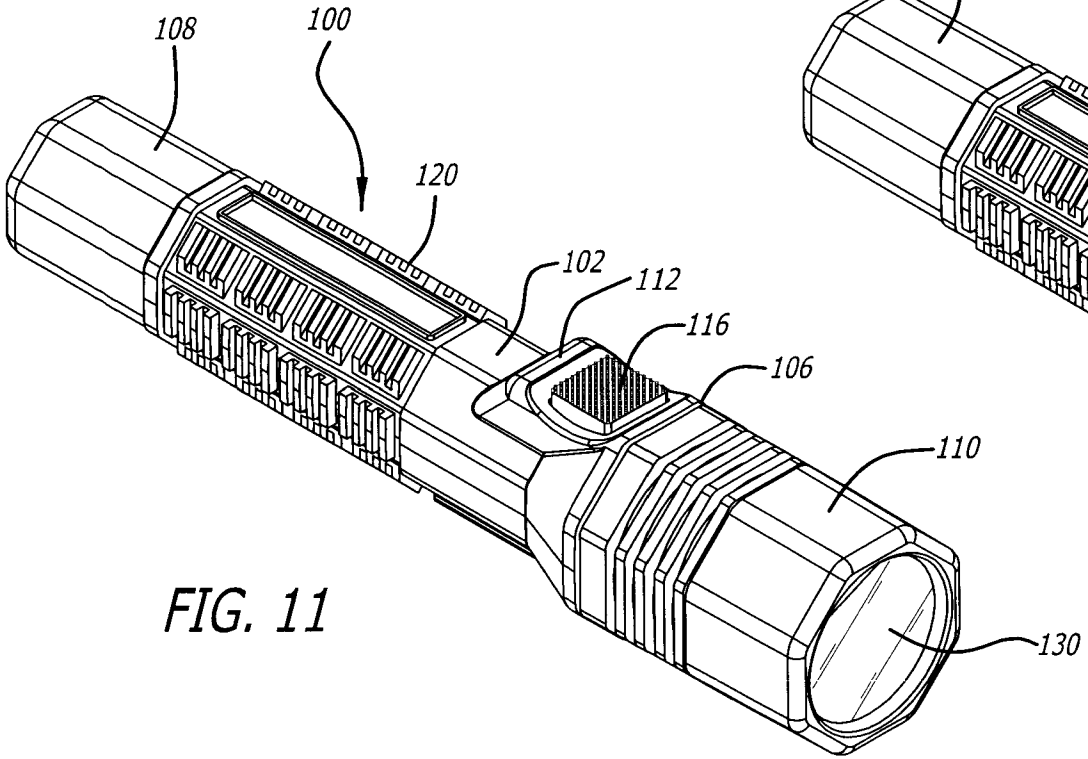
FIG. 11 is an oblique view of the flashlight in FIGS. 1 through 5.
Figure 13:
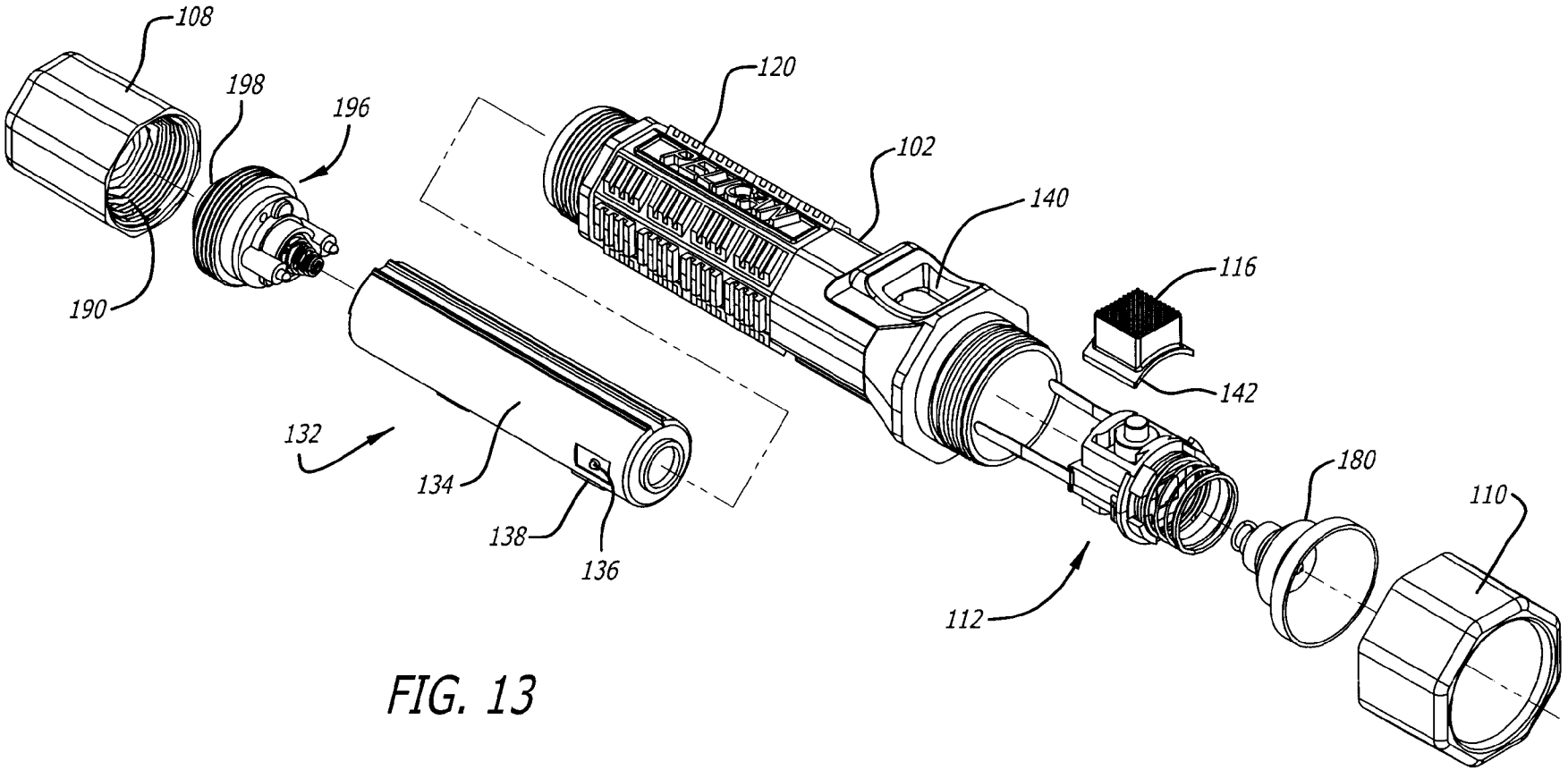
FIG. 13 is an exploded view of the flashlight in FIGS. 6 through 10 and FIG. 12. This exploded view shows the tail portion with the second switch in the tail cap, and the battery housing above-second switch, the barrel portion into which the battery is located. The first switch is shown in the body with the push button cover removed. The head is shown in the forward extended exploded position with the lens between the switch mechanism and the top of the head.
Figure 14:
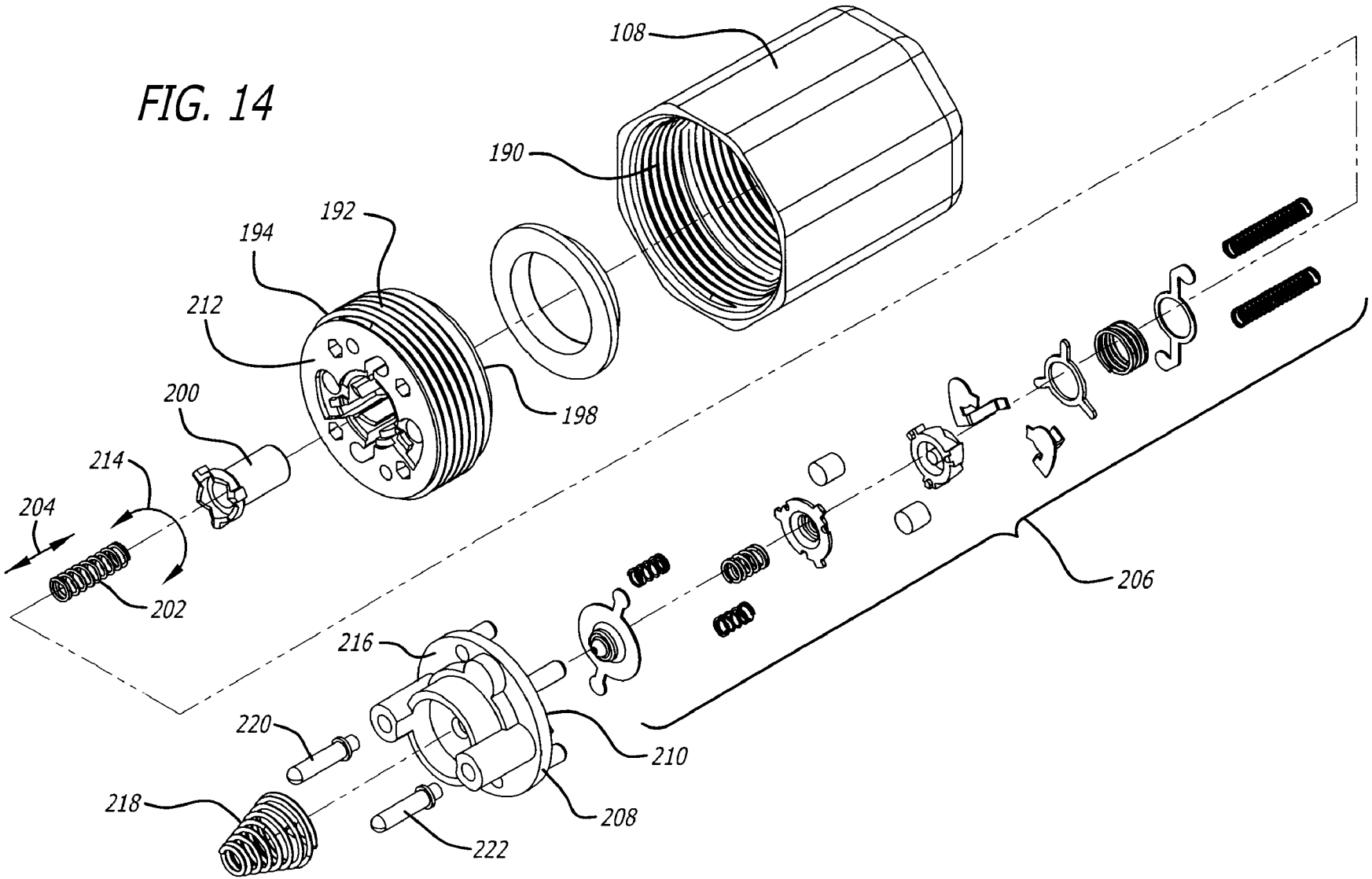
FIG. 14 is an exploded view of the tail cap of the flashlight showing the tail cap, the screw-in support base structure and mechanism for the switch, the push button spring activated switch components and the mating top structure or plate for the switch with the spring located essentially on the top structure plate and two contacts extending from that plate or structure for location towards the battery.
Figure 15:
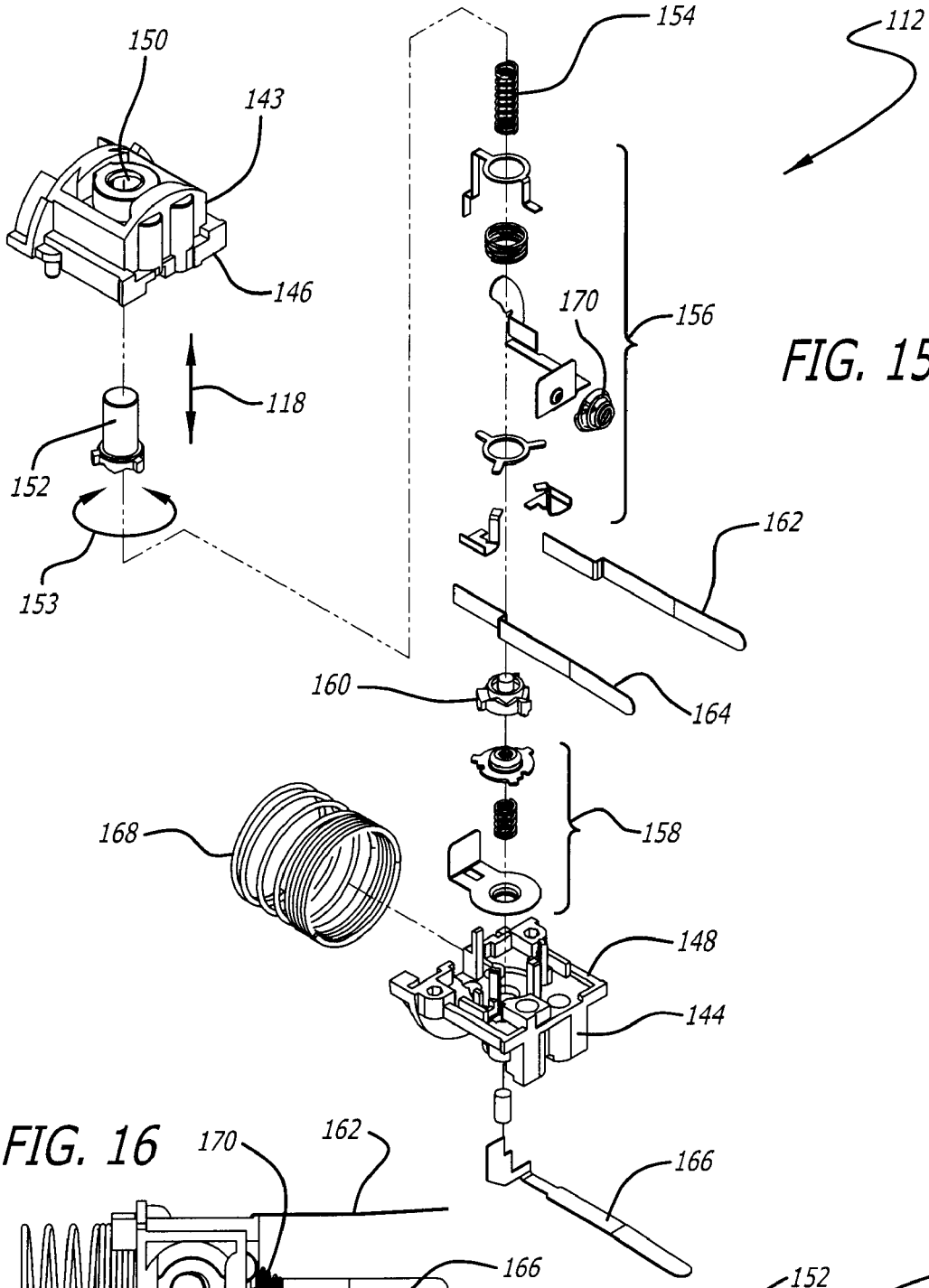
FIG. 15 is an exploded view of the first switch, namely, the transverse switch for location in or near the intermediate part of the body. The transverse switch has two structural mating elements with which is located a spring mounted plunger-pin mechanism which operates with one or more spring mechanisms. The pin is normally outwardly biased. Rearwardly directed from the transverse first switch, there are at least three contact links which are directed towards the battery casing.
Figure 16:
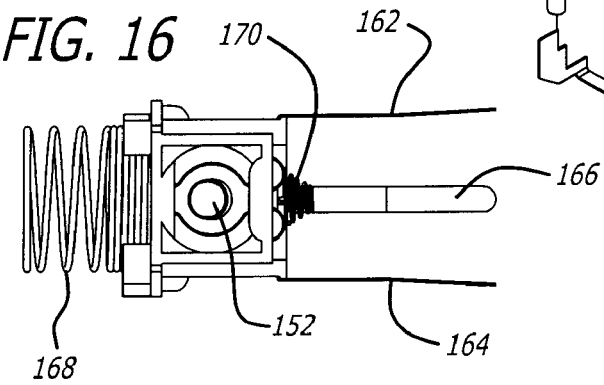
FIG. 16 is a top view of the first switch, namely the transverse switch without the battery casing in place.
Figure 17:
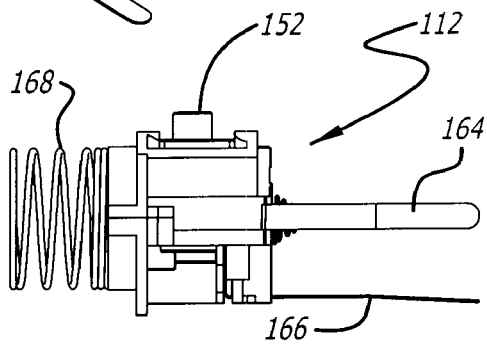
FIG. 17 is a side view of the first switch and turned relatively through 90 degrees relative to FIG. 6 without the battery casing in place.
Figure 18:
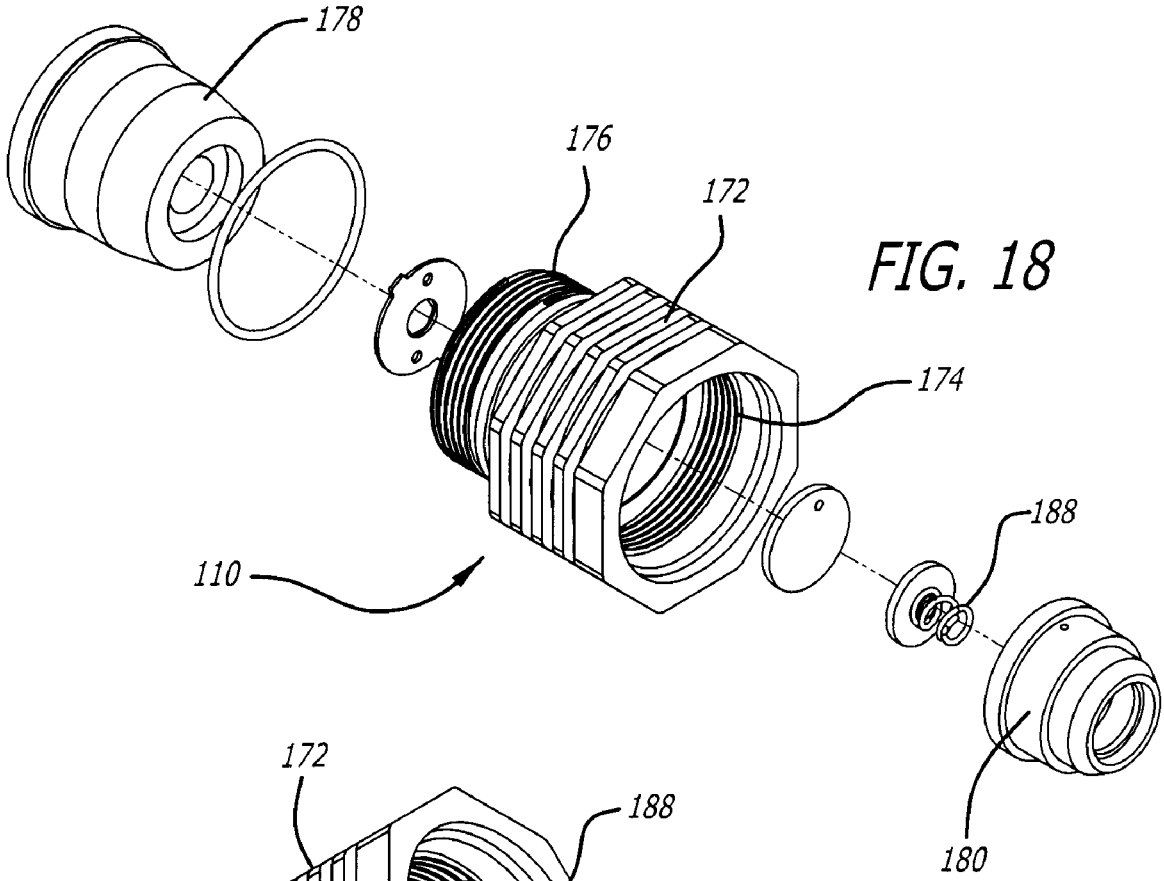
FIG. 18 is an exploded perspective view of the lens structure and configuration showing the reflector, a housing into which the reflector fits and a base for securing the reflector with a spring member. The lamp is an LED configuration.
Figure 19:
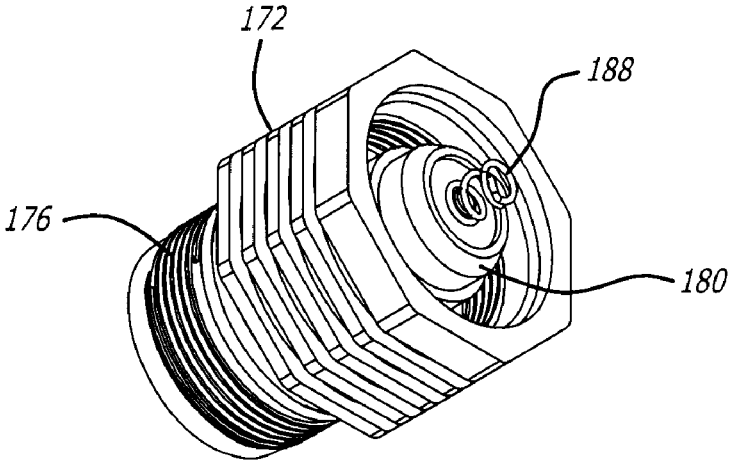
FIG. 19 is a perspective view showing the assembled format of the body assembly securing the lens and reflector structure and configuration.
Figure 20:
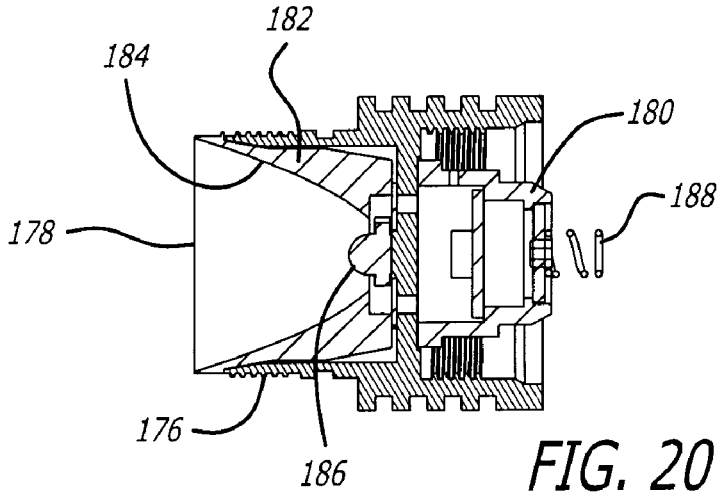
FIG. 20 is a side sectional view of the lens structure and configuration and the intermediate body portion holding the lens structure and configuration.
Figure 21:
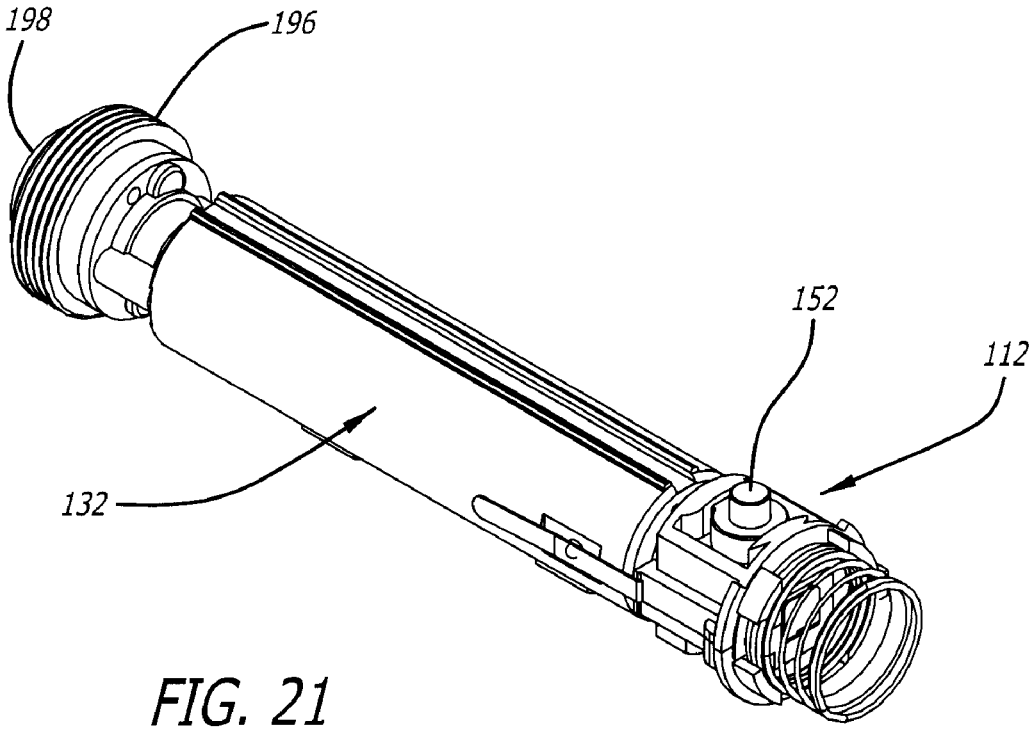
FIG. 21 is an isometric view showing the second switch for the tail of the flashlight, the intervening battery pack and the first switch at the head of the second switch for the tail of the flashlight, the intervening battery pack and the first switch towards the head of the flashlight, the first switch having three terminal limbs directed rearwardly along the outer body of the battery pack or casing.
Figure 22:
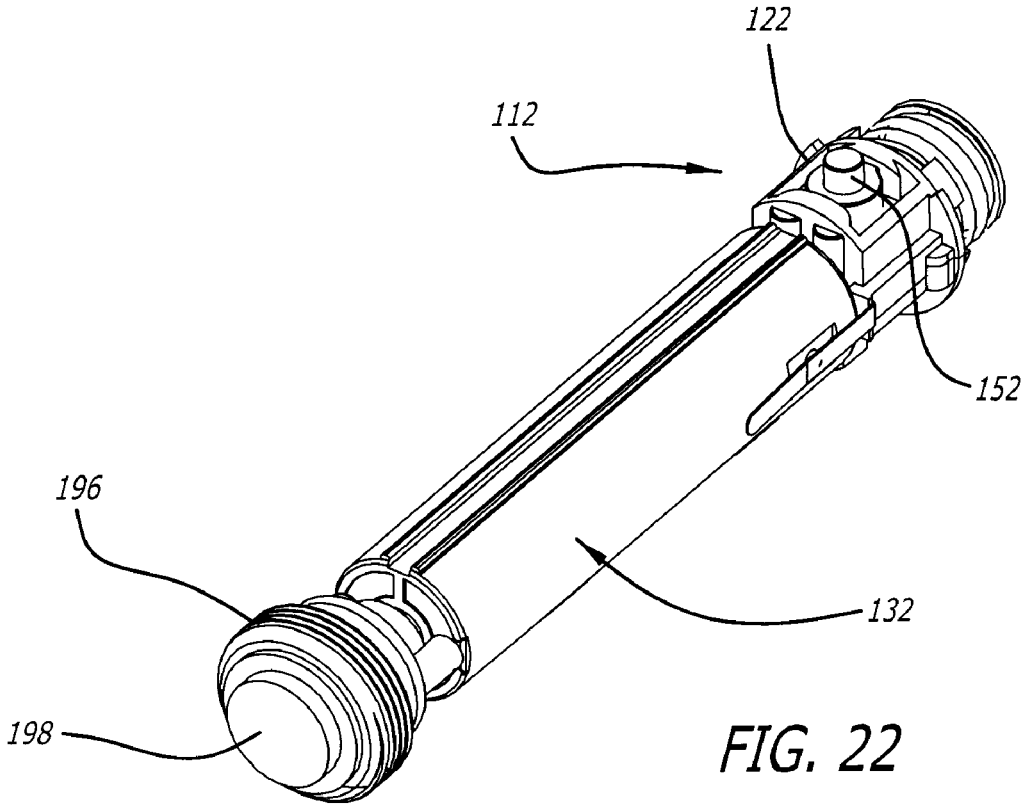
FIG. 22 is an isometric view, viewed from the rear showing the tail switch, the battery pack and the first switch with a rearwardly directed terminal directed along the body of the battery pack.
Figure 23:
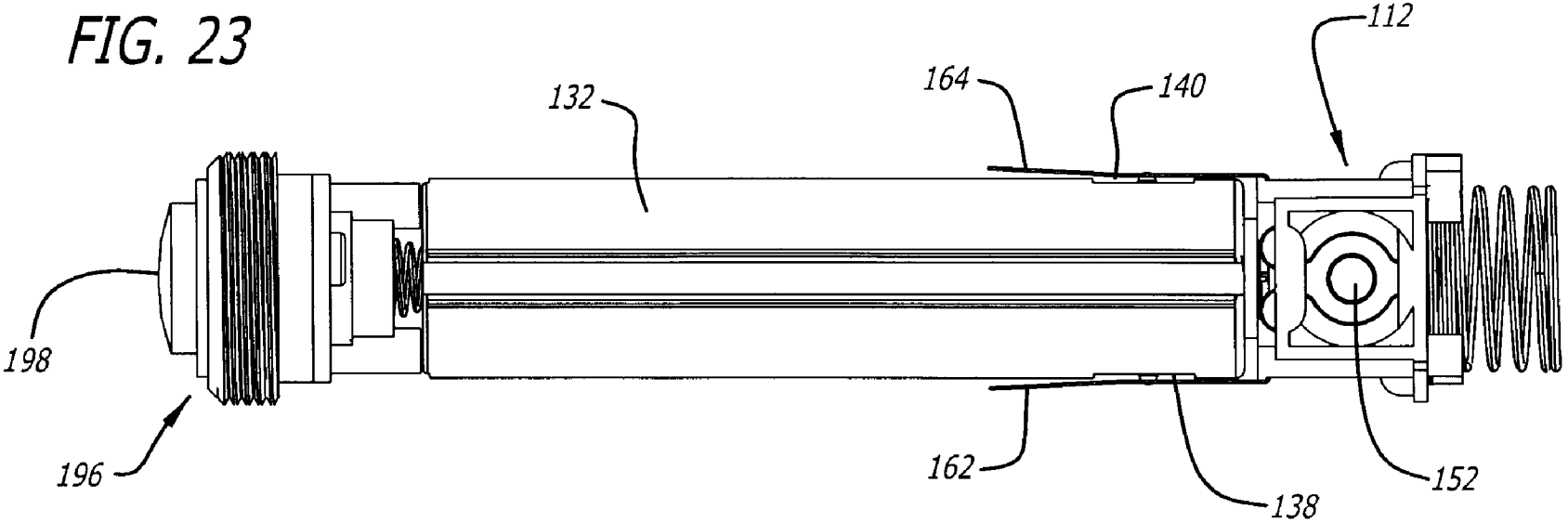
FIG. 23 is a side view from the top of the battery pack showing the tail switch or second switch, battery pack and the first switch, namely the transverse switch. The connector terminals are directed along the battery pack.
Figure 24:
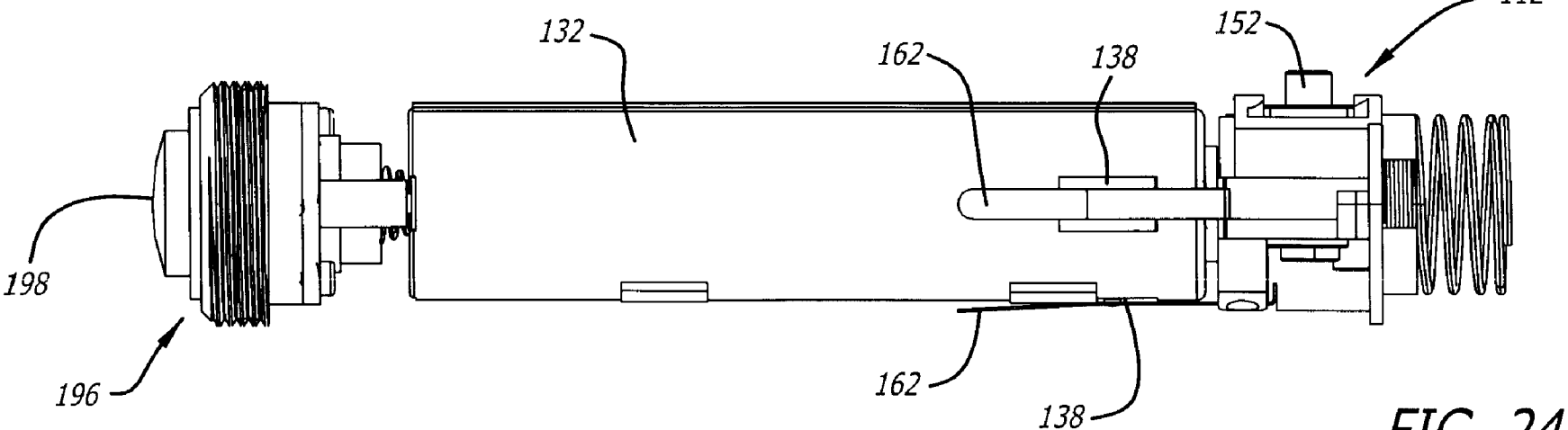
FIG. 24 is a side view of the configuration of the second switch, namely, the tail switch, the battery pack and the transverse switch. The view of FIG. 24 it is turned 90 degrees relative to the view of FIG. 23.
Figure 27:
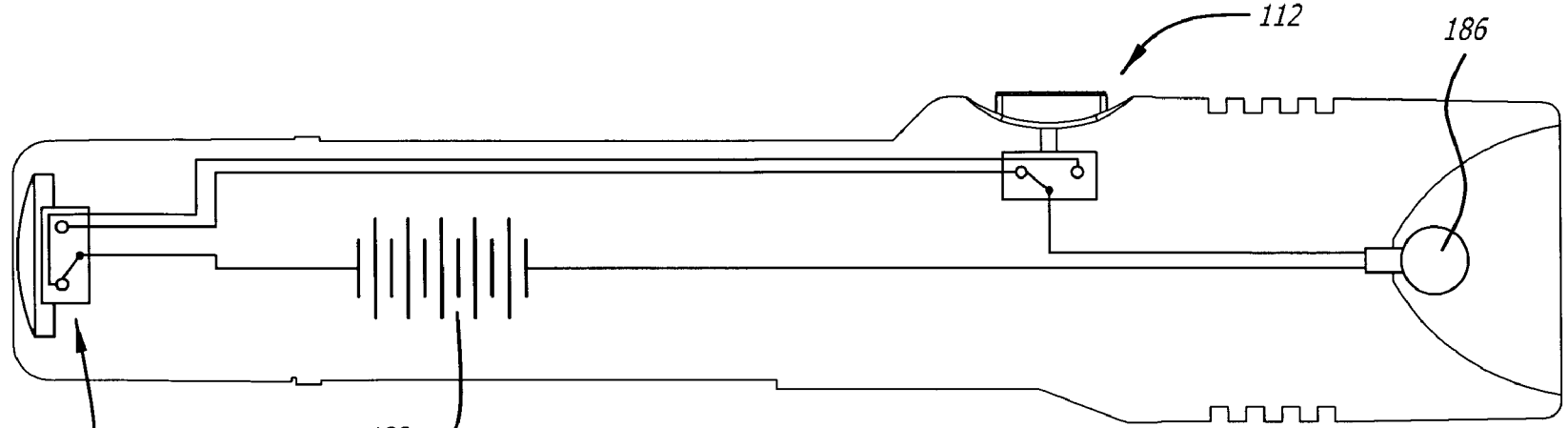
FIG. 27 is a side schematic view of the flashlight showing the 3-way switches in an electrical circuit and the flashlight off.
Figure 28:
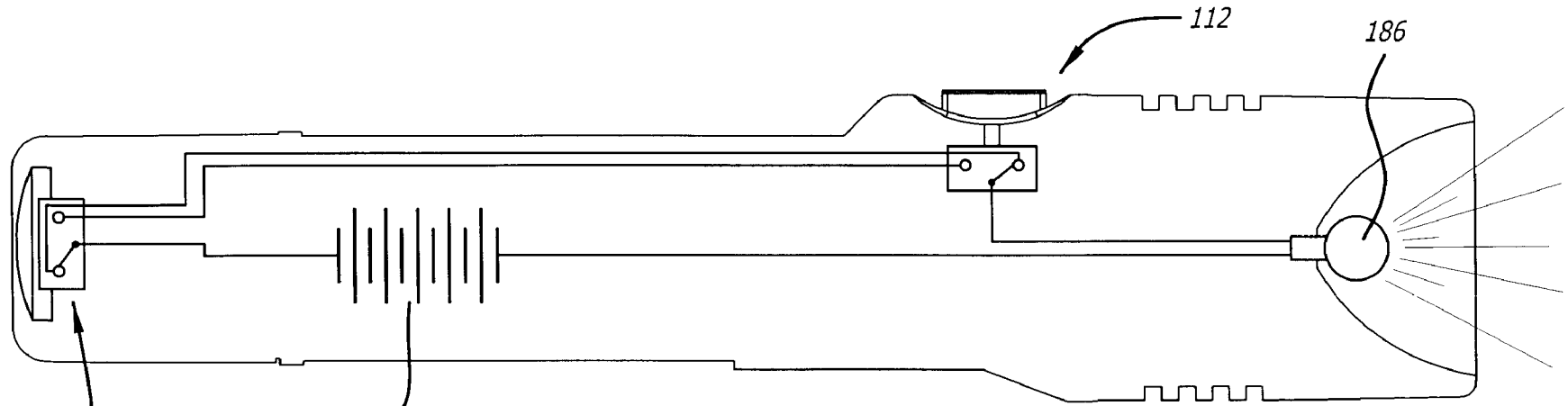
Figure 29:
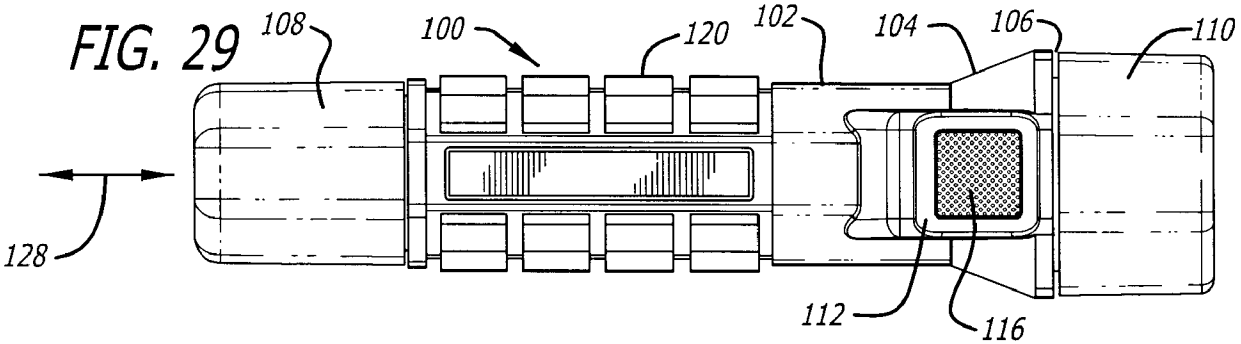
FIGS. 29 through 34 are respectively similar to FIGS. 1 through 5 and 11 of the flashlight. The outside configuration is different, having a grenade type outer inter-engaging surface outside the barrel.
Figure 30:
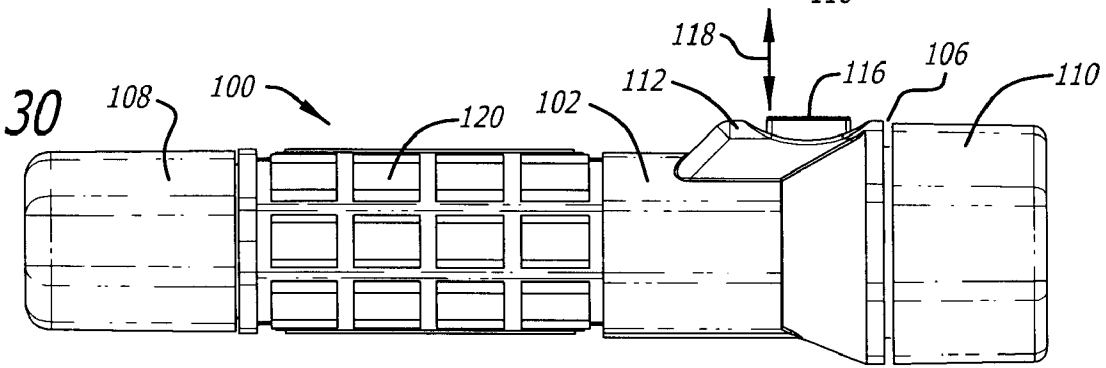
Figure 31:
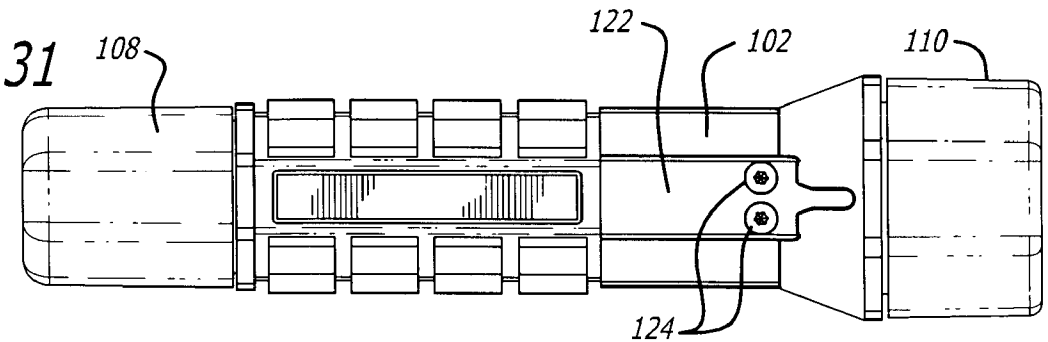
Figure 32:
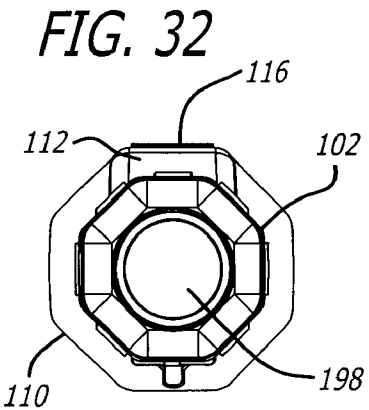
Figure 33:
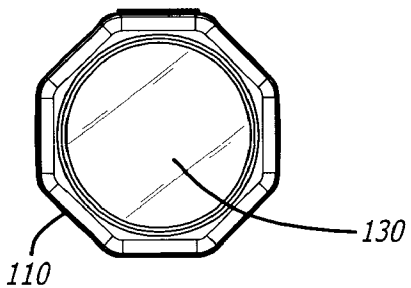
Figure 34:
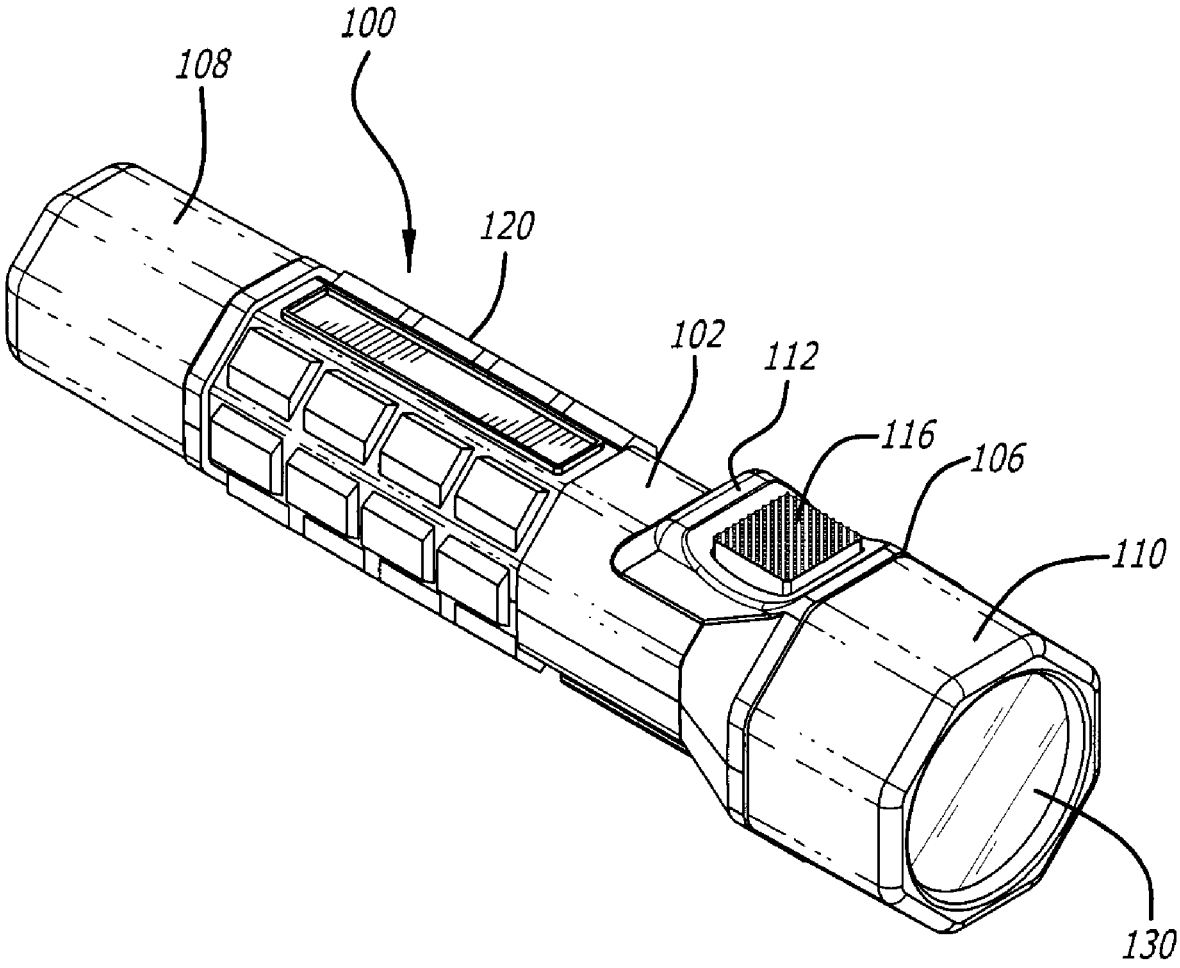

A flashlight comprises a body for receiving a battery, the body having a longitudinal axis and a top and a base. There is a head on the body having a reflector and a light emitting source. Contacts below the head are for making connection with contacts on a recharger device.

There is a circuit for operation to signal to a user that the battery voltage is at selected voltage or power level.

Also there is at least one switch, the switch acting relative to the body to open and close an electric circuit between the battery and the light emitting source. The signal is activated when the voltage level is at a selectively low threshold, such threshold being preferably at a relatively low level relative to a full voltage level. The signal is a flashing on and off repeatedly for a selected time period before the light emitting source is extinguished.

In one form there is at least one 3-way switch, the switch acting in one selective form, to move inwardly and outwardly relative to the body to open and close an electric circuit between the battery and the light emitting source.

In one form there at least two switches, preferably 3-way switches for selectively opening and closing a circuit between the battery the light emitting source, a first switch being in a first location on the flashlight and a second switch in a different location on the body. A first switch is a side switch and a second switch is a tail switch. The 3-way switch function allows the flashlight to be turned on using the side switch and turned off with the tail switch and vice versa. At least one and preferably both switches operate with a momentary on function, the momentary on function being for turning on the flashlight when the switch is operated with a predetermined amount of manual pressure and turning off when the manual pressure is reduced below the predetermined amount.

In one form there is an electrical circuit between the switches to open and close an electric circuit between the battery and the light emitting source, which is an LED. An LED module includes a heat sink, and selectively a metal core printed circuit board for permitting receipt of a different LED, and the reflector is part of the module. There is an LED module including an aluminum heat sink as part of the LED module for thermal management.

There is a circuit board, the circuit board having at least one of thermal fold back, and the reflector is exchangeable for a second reflector having characteristics different to the first reflector.

There is a first spring extending downwardly from the area of the first switch to the top of a battery and a second spring between the bottom of a battery and a base of the body. An electrical contact strip connection is directed along the side on the inside of the barrel from the battery bottom to one contact on the side of the light emitting source, and the light emitting source module includes a heat sink for thermal management.

There can be a stud-like first contact member between the switch device and the battery top being part of the electrical circuit; the first spring being in contact with the top of the battery; and the second spring between the battery bottom and the base of the body not constituting part of the electric circuit.

The lamp assembly located at said front end of said elongated battery barrel includes the light emitting source and light emitting source reflector pointing longitudinally away from the elongated battery barrel, and the light emitting source can be a Xenon bulb or an LED.

The flashlight of the disclosure can be used for the law enforcement market. It can use a Xenon bulb or an LED version.

One feature of this flashlight is that it has two 3-way switches, namely a first switch, the side switch or transverse switch and a second switch, namely the tail switch. Some police officers prefer a side switch and others prefer the tail switch. There are instances when use of the tail switch is required (for example, in a tactical situation); one may need to use the tail switch when holding a hand gun with the other hand. The 3-way switch function allows the user to turn on the flashlight using the side switch and turn it off with the tail switch and vice versa. This feature is useful when the user forgets which switch was activated to turn on the flashlight. One or more the fingers or thumb can be used for this.

Another feature is that both switches have the momentary ON function. Momentary ON function turns on the flashlight when the switch is depressed and it turns off when the switch is released. The 3-way switches are common, for instance, in domestic hallway lighting, however none of those operate with a momentary function.

The flashlight has dual 3-way switches. Dual 3-way switches, selectively with and without momentary ON function in a flashlight, and selectively having a momentary feature in at least one of the dual 3-way switches are advantageous.

The contacts on the battery pack assembly that connect the tail switch operation to the side switch preferably do not serve any function of the battery, but in other circumstances can act with the battery.

The LED module can include an aluminum heat sink as part of the LED module for thermal management. There is a metal core printed circuit board (MCPCB) for accepting an LED footprint from various LED suppliers. The reflectors are of modular design, and the built in circuit board has a thermal fold back and short circuit protection. The modular reflector is capable of being swapped out for different reflectors for different angles, and other characteristics. There is an integrated heat sink with LED which is part of LED unit. Further, the circuit system is such that, should there be overheating, the circuit can drop down to less power for instance, 50% power, and still operate. As the circuit board is universal, it can take different LED units. There can be different configurations and/or layouts of the board.

The flashlight 100 includes a barrel body portion 102, intermediate area 104, and a top 106. The barrel 102 is connected with a tail cap 108 and there is a head portion 110 connected to the top 106. In the intermediate portion 104, extending in part to the barrel 102, there is a first switch construction 112 which is a push button 116 for operation as indicated by arrow 118 in an up down fashion transversely relative to the length of the flashlight. The outer part of the barrel can have a grip formation or sleeve 120 to facilitate gripping action with the hand of a user. The underneath of the barrel 102 has a plate 122 with terminals 124 for interaction with a re-charger device where the flashlight thus can be connected into a re-charger unit in any acceptable format. In other cases the flashlight may not be a re-chargeable flashlight and different battery configuration can be used in the flashlight.

The tail cap portion 108 and the barrel portion 102 are relatively smaller in overall cross-section than the head portion 110 of the flashlight. The foot of the tail cap has a push button cover 198 which is for movement inwardly and outwardly as shown by arrows 128. This second switch operates in the tail of the barrel of the body of the flashlight 100.

The head 110 holds a lens and reflector configuration inside the area indicated as numeral 130.

As shown in the exploded view, there is a battery pack 132 with a casing or sheath 134 with terminals 136 and 138 and 140 arranged on the sheath around a battery pack.

The push button 116 fits into a cavity 140 in the body of the flashlight barrel. The lip 142 around the base of the cap prevents the button from moving outwardly from the barrel and also helps sealing of the flashlight configuration.

The first switch, namely, the transverse side switch includes two plastic structural body members 143 and 144 which mate together at the interface 146 and 148, respectively. The component member 143 has the aperture 150 through which a push button 152 can enter for movement in the upward and downward direction indicated by arrow 118. There is a spring 154 which fits in part into a hollowed portion inside the push button post or pin 152 and a multi-component ring and connector configurations illustrated collectively as numeral 156 which interact with a secondary set of components collectively shown as numeral 158. The post 152 is rotatable as indicated by the arrow 153.

Through these components, the configuration is of the nature that when push button 152 is depressed it causes rotation of one or more components, for instance, component 160 which acts in one of three ways. The operation of the switch 112 acts to close a circuit with the battery pack, open the circuit with the battery pack or act for a momentary ON position.

Extending rearwardly from the switch structural bodies 143 and 144 are three elongated contact limbs 162, 164, and 166, respectively. These limbs make contact with the outside of the casing of the battery pack 132 in a manner that enables the circuit to be closed with the battery pack as appropriate.

There is also a spring 168 directed forwardly of the switch 112 for an engagement with the lens configuration within the head 110. Another spring 170 engages the top of the battery pack in an appropriate manner as well. The button 152 is covered by the cap 116 as necessary.

The housing 172 above the intermediate part of the flashlight and below the head 110 for the lens configuration includes the cylindrical portion with an internal threaded section 174 for engaging on the top part of the barrel which has a complimentary external threaded section. It also includes external thread 176 section for engaging with the internal threaded section of the head 110.

The housing 172, which is a heat sink coupling, houses the body of the reflector 178 which has a separate brass can section 180 which fits into the intermediate housing 172 adjacent to the top of the barrel. Section 178 fits into the intermediate section adjacent to the head 110.

The lens 182 includes the reflector body 178 with a reflecting surface 184 with the central part of the reflector that locates the LED 186 or other light source. The spring configuration 188 on a brass rivet provides a suitable resilience to the device and the shock absorbance as may be necessary. It may also act as one of the electrical terminals or the other portion of the electric circuit could be through the can 180. The spring configuration is also mounted with part of a contact board, and in turn ahead of the contact board there is the converter board assembly unit and the LED/MCPCB unit. There is a silicon O-ring which fits over the threads 176. Rearwardly, a thermal conductive compound is applied between the base of the reflector body 178 and the inter-engaging facer of the portion 172.

The tail cap 108 includes internal threads 190 for engaging the external thread on the barrel 102 at the base of the barrel and the threads 190 also engage the external threads 192 of the body 194 of the second switch 196. The second switch 196 includes a cover cap 198 which covers a rotatable pin post 200 which is hollow to seat a spring mechanism 202 to facilitate inward and outward movement as indicated by arrow 204. There are multiple mechanisms collectively shown by numeral 206 which act as part of the switch configuration of the second switch 196.

The body 194 has a mating body 208 which fits with the top part of the body 194 so that the interface 210 engages the interface 212 in an appropriate manner. Between those two components and within the interface the different components of the switch unarranged in the configuration is such as that there is relatively rotatable pin post 200 which is also relatively rotatable as indicated by arrow 214 as it moves in and out as indicated arrow 204. This is similar to the rotatable post 152 which is rotatable as indicated by the arrow 153.

Mounted in a forward direction on the face 216 of the body 208, there is a spring 218 for engagement with the base of the battery pack 132. There are also two contact pins 220 and 222, respectively, which are for making electrical contact with the casing of the battery as appropriate. These pins close the electrical circuit as necessary between the battery and LED 186 in the lamp holder. The spring 218 provides an electrical circuit as may be necessary and also resiliency between the different components of the flashlight.

Switch 196 acts according to the operation of the cap cover 198 through the pin post 200 to open and close a circuit and thereby switch the LED on or off. This is in addition to having the ON operation to be momentarily on in a designated position of the switch 196. Depression is by thumb or palm pressure on the cap 198 and in turn on the pin 200.

As shown, there is the battery pack 132 with the first switch 112 towards the head of the battery pack and the second switch 196 towards the rear end of the battery pack.

The battery pack 132 includes a casing or sheath 224 around the battery and this sheath is part of the electrical conduction circuit between the LED lamp 186 and through the batteries to the switches 112 and 196 respectively. The terminals on the sheath 224 act to provide continuity in that electrical circuit.

The electrical ON-OFF switches are 3-way switches having ON-OFF positions and the momentary ON switch. The push-button switch actuator is a rotary switch actuator which can releasably block the ON-OFF position push-button switch actuator as desired in a selected position. The tail-end ON and OFF 3-way switch with a momentary ON switching function operates in an OFF position, ON position, and a momentary ON position.

The electrical ON-OFF switch with a push-button switch actuator and a rotary switch actuator, operates to effect electrical ON and OFF switching with the rotary switch actuator. A rotary motion-to-longitudinal motion translator in the rotary switch actuator comprises a rotary motion-to-longitudinal motion translator, and if required a releasable ON position blocker extending from the rotary switch actuator to the ON-OFF position push-button switch actuator. This can block the push-button switch actuator in an OFF position with the rotary motion-to-longitudinal motion translator and includes the motion translator.

In a momentary third position the electric light source is momentarily ON only as long as the external switch is manually held in the third position against the biasing toward the first position.

The battery can be one or more cells connected together to furnish electric current.

The electrical ON-OFF switches have an ON-OFF position push-button switch actuator and there can be a rotary switch actuator. The ON-OFF position push-button switch actuator may be biased to an OFF position, such as by the bias or terminal spring. The actuator is manually actuable against the bias of the spring to the electrical ON position.

The switches may have a cylindrical configuration and the rotary switch actuator may be a manual actuation knob on that base. Such actuation knob or rotary switch actuator may be threaded on the cylindrical switch base by mating threads. The actuation knob or rotary switch actuator may travel back and forth on the cylindrical base, as such actuation knob or rotary switch actuator is manually rotated in the sense of rotation and conversely in the opposite sense of rotation.

The manual rotary motion of the actuation knob or rotary switch actuator is translated into longitudinal motion from the closed switch or ON position to the unblocked OFF position. Hence to the blocked OFF position such as by rotation past the unblocked OFF position switching rotary motion. This translates rotary motion of the rotary switch actuator into a motion of the rotary switch actuator past the OFF switching rotary motion. There is a rotary motion-to-longitudinal motion translator in the rotary switch actuator which extends from such rotary switch actuator to the ON-OFF position push-button switch actuator.

In some cases, the switch can be blocked against accidental activation by one to two extra turns of the actuation knob or rotary switch activator past the unblocked OFF position. The switch actuator may include an elastomeric diaphragm connected to the actuation knob or rotary switch actuator and to the plunger, and preferably covering the assembly on one side.

An electric light source has a housing including a tail-end having a recess in the tail-end and including a switch mounted in that tail-end inside of recess for a stable first position in which the electric light source is OFF, a stable second position in which the electric light source is ON, and a momentary third position biased toward the first position so that the electric light source is momentarily ON only. As long as the switch is manually held in such third position against it's biasing toward the first position.

The flashlight beam can be used with a first LED or other lamp and reflector assembly, or can be used with an alternative second lamp and reflector assembly as desired. The first lamp and reflector assembly and a second assembly are for light beams of different configurations as desired.

The first light beam with a first lamp and reflector assembly may be removed and an alternative second lamp and reflector assembly may then be substituted. A second light beam of a different configuration may then be used with that alternative second lamp and reflector assembly. The alternative second lamp and reflector assembly is different from the first lamp and reflector assembly.

The first light-beam lamp and reflector assembly can have a different light-beam casting unit relative to a second lamp and reflector assembly. There can be a common receptacle in the flashlight for that first light-beam-lamp and reflector assembly and alternatively for that second lamp and reflector assembly. These different assemblies may have like threads for alternatively fitting into a mating thread in the common receptacle.

Desired configurations of light beams may be realized by appropriate dimensioning and relative location of lamp and reflector in each assembly, or by other conventional means. A spread light beam may with the first lamp and reflector assembly, and a narrow light beam may alternatively be with the alternative second lamp and reflector assembly.

A first lamp housing having a light beam spreading electric light source and reflector assembly for emitting a spread light beam. A second lamp housing having a narrow light beam emitting electric light source and reflector assembly. "Spread" and "narrow" are relative terms, with the second light beam being narrower than the first light beam.

The lamp housings may have like spring terminals for a supply of electric battery power to the light source. An additional spring may be provided for shock absorbing purposes. Features of various aspects of the invention may advantageously be combined.

Different light beams may be energized from different electric power supplies, if desired, and different lamp and reflector assemblies may be provided and used for different electric power supplies. Different light-beam lamps and reflector assemblies may be combined with switch systems for greater versatility.

The flashlight may comprise a first light-beam-casting lamp and reflector assembly, a different light-beam-casting second lamp and reflector assembly, a common receptacle for the first light-beam-casting lamp and reflector assembly. Alternatively for the second lamp and reflector assembly, there is an electrical ON-OFF switch for a lamp in either of such first and second lamp and reflector assemblies. There can be an ON-OFF position push-button switch actuator and a rotary switch actuator in that electrical ON-OFF switch, and a releasable ON position blocker extending from the rotary switch actuator to the ON-OFF position push-button switch actuator.

Either one or both of the switches can be an electrical ON-OFF switch for the lamp in either of the first and second lamp and reflector assemblies.

The flashlight switching through the thumb area covers the thumb and also the ball of the thumb, which is the rounded eminence by which the base of the thumb and is continuous with the palm of the hand.

The flashlight with a battery barrel provides a tail-end switch for that flashlight. The flashlight 100 includes an elongated battery barrel having a front end and a tail-end opposite that front end. The lamp assembly is located at the front end of the elongated battery barrel and includes a lamp and lamp reflector pointing longitudinally away from the elongate battery barrel. The battery barrel is provided at its tail-end with the tail-end switch for the flashlight. The tail-end switch for the flashlight on the battery barrel thus is at the tail-end and electrically connectible to the lamp.

A lamp assembly can have the lamp housing or bezel threaded on an end portion or projection of the battery barrel. The lamp assembly may be mounted on the battery barrel by means other than threading.

The lamp assembly can have spaced first and second lamp terminals and adapted to contact the battery barrel and the battery terminal, respectively. Terminal springs may act like shock-absorbers, guarding the lamp against shock loads and against impact from a shifting battery. The bulb can include an LED or incandescent filament connected between lamp terminals or springs and for energization through battery terminals when the tail-end switch or transverse switch is depressed. The springs may be held in a piece of ceramic or other electrically insulating material or retainer which may also mount the lamp or bulb.

The switching function of the flashlight is not limited to any particular kind of electrical or mechanical switching mechanism. The tail-end switch includes a plunger capable of contacting an end portion of the barrel. A spring at the battery terminal biases the plunger away from the barrel end. No electric current flows from the battery to the lamp, as the plunger is also electrically insulated from the barrel by an elastic O-ring. The tail-end cap either is of electrically insulating material or is electrically insulated from the battery barrel.

The switching feature is combined with a rotary or longitudinal switching feature. In some cases, there can be a tail cap which may be rotatable or otherwise movable relative to the barrel until the lamp is lit. The lamp or flashlight may then be lit by a relatively small depression of a flexible diaphragm or other actuation of the plunger, such as by a finger, thumb or thumb area. The travel of the diaphragm or plunger required for actuation of the flashlight, or the "touch" of the flashlight is easily adjustable for different persons and preferences by preliminary rotary or other motion of the tail cap relative to the barrel.

A flashlight including a body which has a substantially regular first cross-sectional area between the base of the body and the top portion of the body. The first cross-sectional area is defined on the outside by an octagonal configuration and the internal configuration is formed substantially as a circular structure. The body includes the barrel.

Ahead of the body portion there is the intermediate portion defined by a second cross-sectional area. Ahead of the intermediate portion there is the head portion which is relatively enlarged. The intermediate portion includes a protrusion on one side, namely one of the octagonal sides of the flashlight. The protrusion is for housing in part, the first switching device.

The head portion includes a lens and within the lens an LED or other bulb. The body portion outside surface octagonal configuration can include two circumferential lips. A lip is located substantially at the uppermost portion of the body portion around the outside. A lip is also located towards the base portion around the outside of the body portion. These lips provide a receiving area for receiving an extruded resilient, flexible and stretchable sleeve, which can fit within the circumferential trough, formed between the lips. The outside surface of the sleeve is substantially flush with the outside surface of the body portion when in position between the lips.

The intermediate portion has a second cross-sectional area, which is relatively larger than the first cross-sectional area of the body portion. The second cross-sectional area extends relatively to one side of the longitudinal axis running through the body portion, and it is this extended portion which acts to receive the switching device.

At the extended portion there is provided a transverse aperture through which a manually operable movable switching arm or push post pin button of the switch device or assembly is located. A switch pad button cover is provided to the movable arm or push post pin. The manually operable switch arm can be depressed to activate the spring operated switch assembly so as to close and open electrical contacts in the switch device. The opposite end of the switch device is connected with electrical contacts which are transversely directed relative to the body, namely at the intermediate portion below the head.

Connecting the extended protrusion of the intermediate portion with the body portion, there is a relatively tapered zone. Connecting the extended intermediate portion with the head portion, there is also a tapered zone. The head portion is formed such as to have a relatively greater cross-section than the intermediate portion. The location of the enlarged portion is relatively centrally formed relative to the longitudinal axis.

The trailing end of the switch device assembly includes one or more helical springs, which is directed towards the battery. The helical springs are in opposition to each other, and thereby suspend the battery between the springs in a shock-absorbing configuration. One or more of the springs are in electrical contact with the battery, and in electrical contact with a terminal of the switch device.

When the operational arm and push button of the first switch acts to press and depress the plunger mechanism of the switch device assembly, the circuit connecting the battery between the bulb is made or broken through the switch device assembly and electrical contacts within the switch device assembly. The operation of the switch assembly is transverse or relatively radial to the longitudinal axis of the body of the flashlight. The operational arm and push button and the plunger acts relatively radially or transversely in relation to axis and the operational arm and push button is relatively located in a radially opposite position to the contacts on the flashlight.

The switch assembly includes the plunger which operates with one or more springs which are helically and coaxially mounted around the plunger. Suitable contacts are provided for opening and closing and making the flashlight circuit between the battery and the LED bulb.

For the first switch, a suitable button padding is provided to the pin post such as to provide for positive engagement by finger operation of a user.

Figure 35:
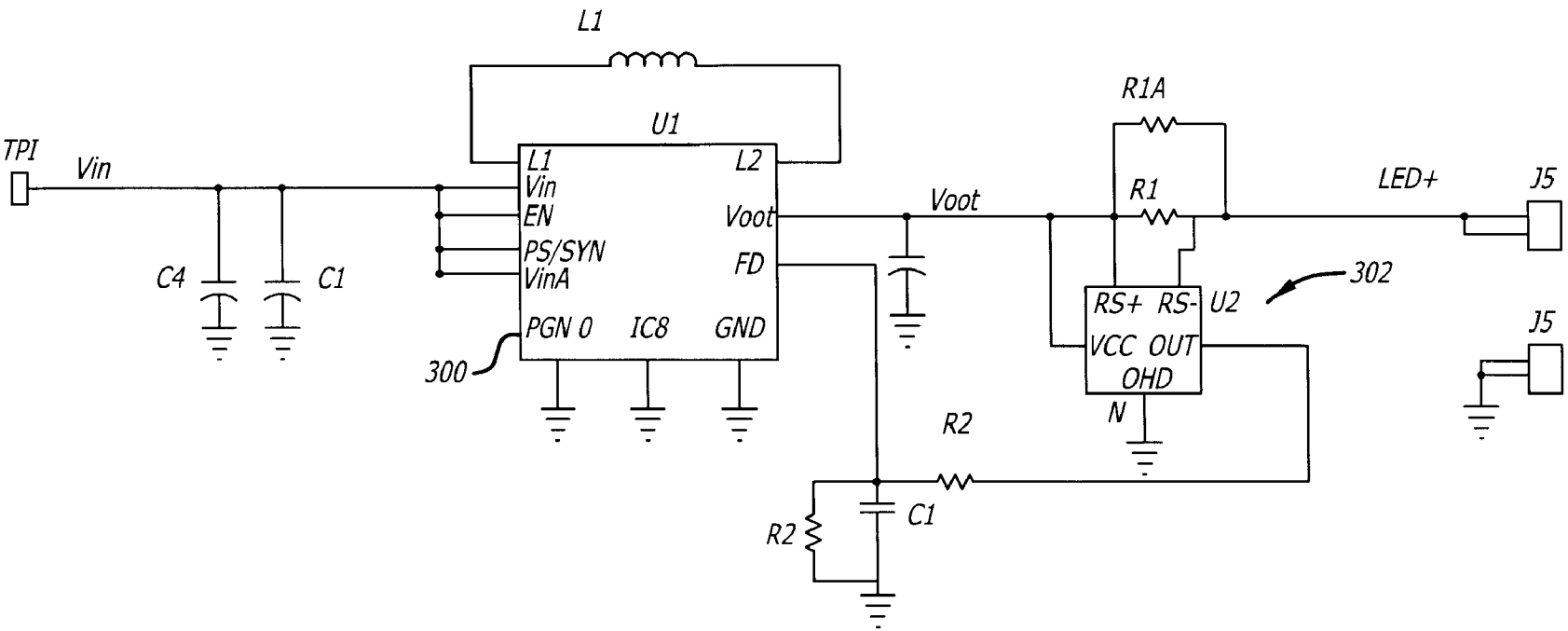
FIGS. 35 and 36 are respectfully two circuit schematics for the LED driver with a flashing system. The GD board of FIG. 34 is a Buck/Boost converter and the board of FIG. 36 is the Low Voltage unit that sensing the low voltage and controls the flashing feature. These two boards are assembled together to drive the LED module.
Figure 36:
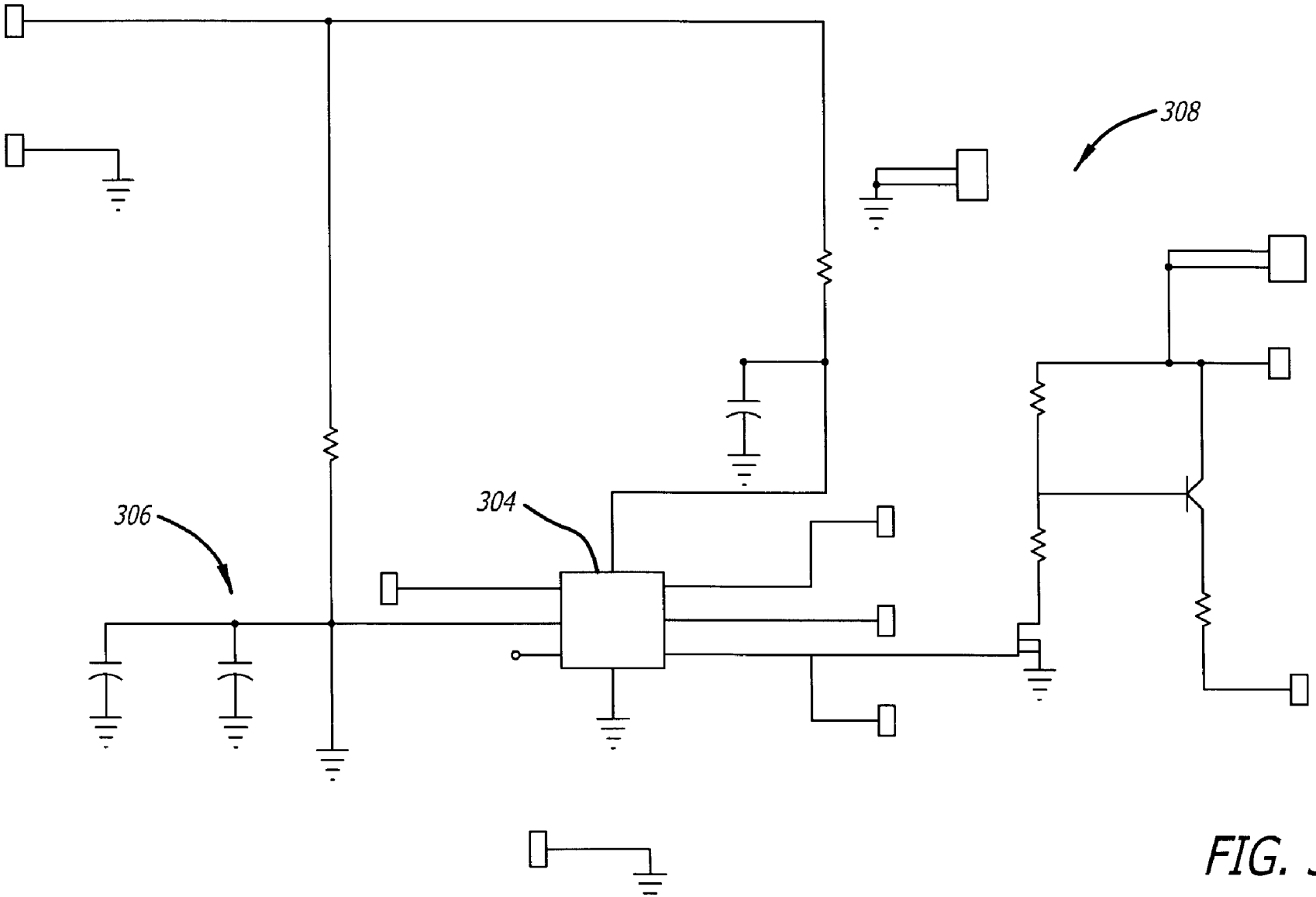

FIGS. 35 and 36 are respectfully two circuit schematics for the LED driver with a flashing system. This is shown for a two switch flashlight. The GD board of FIG. 35 is a Buck/Boost converter and the board of FIG. 36 is the Low Voltage unit that sensing the low voltage and controls the flashing feature. These two boards are assembled together to drive the LED module. A flashlight comprises a body for receiving a battery, the body having a longitudinal axis and a top and a base. There is a circuit for operation to signal to a user that the battery voltage is at selected voltage or power level. The signal is activated when the voltage level is at a selectively low threshold, such threshold being preferably at a relatively low level relative to a full voltage level. In some circumstances this can be in a range of about 1 to 10% of the full power situation, and preferably at the lower side of that range. The signal is a flashing on and off repeatedly for a selected time period before the light emitting source is extinguished. This time period can selectively be about two minutes. In other cases the time period can be different, namely shorter or longer. In other situations, there could be more than one kind of signal, namely signals at different levels of power.

In FIG. 35 there is shown a schematic of different components. There is an IC 300 which is a buck boost controller and an IC 302 which is a current sense amplifier. Different resistors and capacitors are part of the circuit. In FIG. 36 there is a microprocessor 304 operational with an N channel MOSFET 306 and an amplifier 308. Different resistors and capacitors are part of the circuit.

The signaling system can operate with any appropriate flashlight even where there is a single switch to open and close an electric circuit between the battery and the light emitting source.

Many other forms of the disclosure exist, each differing from the other in matters of detail only.

For instance, there can be situations with or without a shock-absorbing shroud around the lens or barrel. Instead of helical springs on either side of the battery which can be of a different configuration, including rechargable nickel-cadmium configurations, there can be different spring formations to provide effective shock absorbing characteristics to either side of the battery. In other cases, instead of a longitudinal flashlight, there can be other different shapes of a flashlight each suitable for different purposes. In some cases, one or more of the switches may be a non-3 way switch.

Generally, the configuration of the components is of the nature that the units are relatively water impermeable and, in this manner, the configuration of the components are tight fitting and of a material such that the ingress of water into the inner workings and compartments of the battery is relatively difficult under normal and even relatively rugged working conditions.

While the disclosure has been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A flashlight comprising:

an elongated axial member for housing a power source, the member having a front end and a tail end at an opposite end of the member, and a side wall between the front end and the tail end;

the member further housing a light emitting source for emitting light along the axial direction of the elongated member and a three-way switching system connecting the power source to the light emitting source;

the three-way switching system having a first switch located on the side wall, wherein the first switch is closer towards the front end of the member than the tail end, and a second switch located on the tail end, wherein the three-way switching system allows the flashlight to be turned on using the first switch and turned off using the second switch and vice versa and wherein each of the switches also operates in the three-way switching system independently of the other switch so as to be able to independently switch the light emitting source on or off;

the first switch being a side switch and the second switch being a tail switch;

the first switch and the second switch both including an electrical connection with the three-way switching system, the first switch and the second switch acting to open and close the three-way switching system between the battery and the light emitting source;

the side wall having an inner surface and an outer surface;

the three-way switching system connecting the battery to an electrical contact on the light emitting source; and wherein both of the first switch and the second switch include a momentary on function, the momentary on function is for closing the three-way switching system when manual pressure used to operate either of the switches reaches a predetermined threshold and for opening the electrical circuit when manual pressure is reduced below the predetermined threshold.

2. A flashlight as claimed in claim 1, wherein the light emitting source is an LED.

3. A flashlight as claimed in claim 1, wherein the power source is a rechargeable battery, wherein the rechargeable battery includes a battery pack that is part of the circuit between the first switch and the second switch.

4. A flashlight as claimed in claim 1, elongated member, the front end and the tail end are essentially cylindrical members.

5. A flashlight comprising:

an axial body member for housing a power source, the body member having a leading end and a base end at an opposite end of the body, and a side wall between the leading end and the base end;

a head for engaging the leading end;

a light emitting source at the leading end;

a tail for engaging the base end and having a tail end;

wherein the body member, the head and the tail are axially aligned and define a single axial direction;

a three-way switching system connecting the power source to the light emitting source, the three-way switching system having a first switch located on the side wall, wherein the first switch is closer towards the leading end of the body member than the base end, and a second switch located on the tail end, wherein the three-way switching system allows the flashlight to be turned on using the first switch and turned off using the second switch and vice versa, and wherein both of the first switch and the second switch includes a momentary on function, wherein the momentary on function is for closing the three-way switching system when manual pressure used to operate either of the switches reaches a predetermined threshold and for opening the electrical circuit when manual pressure is reduced below the predetermined threshold; and the first switch and the second switch both including an electrical connection with the three-way switching system, the first switch and the second switch acting to open and close the three-way switching system between the battery and the light emitting source.

6. A flashlight as claimed in claim 5, wherein the tail end includes a single switch, the single switch being directed for operation to switch on and off by pressure in an axial direction of the flashlight.

7. A flashlight as claimed in claim 5, wherein the light emitting source is an LED.

8. A flashlight as claimed in claim 5, wherein the power source is a rechargeable battery, wherein the rechargeable battery includes a battery pack that is part of the circuit between the first switch and the second switch.

9. A flashlight as claimed in claim 8, wherein the battery pack comprises a casing and a plurality of electrical terminals.

10. A flashlight as claimed in claim 5, wherein the body member, the head and the tail are essentially cylindrical members.

11. A flashlight as claimed in claim 5, wherein the body member is threadably engagable with the head and the tail.

12. A flashlight comprising:

an elongated axial member for housing a power source, the member having a front end and a tail end at an opposite end of the member, and a side wall between the front end and the tail end and wherein the member comprises a head and a tail cap;

wherein the elongated member, the head and the tail cap are axially aligned and define a single axial direction;

the member further housing a light emitting source for emitting light along the axial direction of the elongated member and a three-way switching system connecting the power source to the light emitting source;

the three-way switching system having a first switch located on the side wall and a second switch located on the tail cap, wherein the three-way switching system allows the flashlight to be turned on using the first switch and turned off using the second switch and vice versa, and wherein each of the switches also operates in the three-way switching system independently of the other switch so as to be able to independently switch the light emitting source on or off;

the first switch and the second switch both including an electrical connection with the three-way switching system, the first switch and the second switch acting to open and close the three-way switching system between the battery and the light emitting source; and the three-way switching system connecting the battery to the light emitting source, wherein both the first switch and the second switch have a momentary on function, the momentary on function being for closing the three-way switching system when manual pressure used to operate either of the switches reaches a predetermined threshold and for opening the electrical circuit when manual pressure is reduced below the predetermined threshold.

13. A flashlight as claimed in claim 12, wherein the power source is a rechargeable battery, wherein the rechargeable battery includes a battery pack that is part of the circuit between the first switch and the second switch, wherein the battery pack comprises a casing and a plurality of electrical terminals.

14. A flashlight as claimed in claim 12, wherein the tail cap excludes a battery housing.

15. A flashlight as claimed in claim 12, wherein the flashlight defines an axial direction from the head to the body to the tail and wherein the tail cap includes a single switch, the single switch being directed for operation to switch on and off by pressure in an axial direction of the flashlight.

16. A flashlight as claimed in claim 12, wherein the elongated member, the head and the tail are essentially cylindrical members.

17. A flashlight as claimed in claim 12, wherein the elongated member is threadably engagable with the head and the tail cap.

18. A flashlight comprising:

an elongate axial member for housing a power source, the member having a front end and a tail end at an opposite end of the member, and a side wall between the front end and the tail end;

wherein the elongated member, the front end and the tail end are axially aligned and define a single axial direction;

a light emitting source arranged within the elongate member to be visible through the front end along the axial direction of the elongated member;

an electrical circuit for connecting the power source to the light emitting source, the circuit having a first switch located on the side wall of the elongate member and a second switch located on the tail end of the member, wherein the circuit allows the light emitting source to be turned on using the first switch and to be turned off using the second switch and vice versa, and wherein each of the switches also operates in the circuit independently of the other switch so as to be able to independently switch the light emitting source on or off; and wherein both the first switch and the second switch includes a momentary on function, the momentary on function being for closing the electrical circuit when pressure used to operate either of the switches reaches a first predetermined threshold and for opening the electrical circuit when manual pressure is reduced below the predetermined threshold.

19. A flashlight according to claim 18, wherein both of the first switch and the second switch are biased toward an off state, such that the bias must be overcome by application of pressure greater than a second predetermined threshold to change the at least one switch from the off state to an on state, the second pressure being greater than the first predetermined threshold pressure.

20. A flashlight according to claim 18, having at least two modes of operation:

a first mode being an on mode initiated by pressure action to at least one of the first switch and the second switch and subsequent release of pressure to at least one of the first switch and the second switch; and a second mode being an on mode initiated by holding pressure to at least one of the first switch and the second switch, wherein the second on mode is different from the first on mode.

21. A flashlight according to claim 20, wherein the first switch is located closer to the front end than to the tail end of the elongate member.

22. A flashlight according to claim 18, wherein the first switch is located closer to the front end than to the tail end of the elongate member.

23. A flashlight according to claim 18, further comprising a rechargeable battery.

24. A flashlight as claimed in claim 18, wherein the elongated member, the head and the tail are essentially cylindrical members.

25. A flashlight as claimed in claim 18, wherein the elongated member is threadably engagable with the front end and the tail.

26. A method of operating a flashlight comprising:

an axial body member for housing a power source, the body member having a leading end and a base end at an opposite end of the body, and a side wall between the leading end and the base end; a head for engaging the leading end; a tail for engaging the base end; wherein the body member, the head and the tail are axially aligned and define a single axial direction; a light emitting source at the leading end for emitting light along the axial direction of the body member, an electrical circuit for connecting the power source to the light emitting source, a circuit having a first switch and a second switch;

including:

in a first step closing the first switch of a three-way switching system connecting the power source to the light emitting source to cause the flashlight to be turned on;

in a second step opening a normally closed second switch of the three-way switching system, wherein the three-way switching system allows the flashlight to be turned off;

in a third step closing the first switch of the three-way switching system connecting the power source to the light emitting source to cause the flashlight to be turned on;

in a fourth step opening the first switch of three-way switching system, wherein the three-way switching system allows the flashlight to be turned off;

in a fifth step providing both the first and the second switch with a momentary on feature, and applying a predetermined manual pressure to at least one of the first or second switches of the three-way switching system thereby to connect the power source to the light emitting source to cause the flashlight to be turned on only when and while a manual pressure is applied to operate either one of the respective switches, the manual pressure reaching a predetermined threshold; and in a sixth step releasing the pressure on the closed first or second switch as closed in the fifth step thereby to turn the flashlight off.

27. A method as claimed in claim 26 including having both switches enabled to operate in a momentary on mode, and applying manual pressure to operate either or both of the respective switches of the flashlight in a momentary on mode by applying the manual pressure to reaching a predetermined threshold.

28. A method as claimed in claim 26 including activating the momentary on function when manual pressure used to operate the respective switches reaches a predetermined threshold and for deactivating the momentary on function when manual pressure is reduced below the predetermined threshold.

29. A method of operating a flashlight comprising:

an axial body member for housing a power source, the body member having a leading end and a base end at an opposite end of the body, and a side wall between the leading end and the base end; a head for engaging the leading end; a tail for engaging the base end; wherein the body member, the head and the tail are axially aligned and define a single axial direction; a light emitting source at the leading end for emitting light along the axial direction of the body member, an electrical circuit for connecting the power source to the light emitting source, the circuit having a first switch and a second switch;

turning on the light emitting source of the flashlight through the circuit by using the first switch;

turning off the light emitting source using the second switch and vice versa; and operating each of the switches independently of the other switch so as to be able to independently switch the light emitting source on or off;

applying a first pressure to either the first switch and the second switch up to a first predetermined threshold to close the circuit and turn on as a momentary on function the light emitting source and for opening the electrical circuit when manual pressure is reduced below the predetermined threshold; and operating at least one of the first switch and the second switch in the momentary on function.

30. A method as claimed in claim 29, including overcoming with pressure a biasing of both of the first switch and the second switch towards an off state, such that the bias must be overcome by application of pressure greater than a second predetermined threshold to change the at least one switch from the off state to an on state, the second pressure being greater than the first predetermined threshold pressure.

31. A method as claimed in claim 29 including overcoming with pressure a biasing of both of the first switch and the second switch towards an off state, such that the bias must be overcome by application of pressure greater than a second predetermined threshold to change the at least one switch from the off state to an on state, the second pressure being greater than the first predetermined threshold pressure; and including operating the flashlight in the momentary on mode in both switches.

32. A flashlight as claimed in claim 29, wherein the body member, the head and the tail are essentially cylindrical members.

33. A flashlight comprising:

an elongate axial member for housing a power source, the member having a front end and a tail end at an opposite end of the member, and a side wall between the front end and the tail end;

wherein the elongated member, the front end and the tail end are axially aligned and define a single axial direction;

a light emitting source arranged within the elongate member to be visible from the front end along the axial direction of the elongated member;

an electrical circuit for connecting the power source to the light emitting source, the circuit having a first switch located on the side wall of the elongate member and a second switch located on the tail end of the member, wherein the circuit allows the light emitting source to be turned on using the first switch and to be turned off using the second switch and vice versa, and wherein each of the switches also operates in the circuit independently of the other switch so as to be able to independently switch the light emitting source on or off;

wherein both of the first switch and the second switch includes a momentary on function, the momentary on function being for closing the electrical circuit when pressure used to operate the switch reaches a first predetermined threshold and for opening the electrical circuit when manual pressure is reduced below the predetermined threshold; and wherein both of the first switch and the second switch are biased toward an off state, such that the bias must be overcome by application of pressure greater than a second predetermined threshold to change the at least one switch from the off state to an on state, the second pressure being greater than the first predetermined threshold pressure.

34. A flashlight as claimed in claim 33, wherein the elongated member, the head and the tail are essentially cylindrical members.

35. A flashlight as claimed in claim 33, wherein the elongated member is threadably engagable with the front end and the tail end.

* * * * *